US011545781B2

(12) United States Patent
Yudate et al.

(10) Patent No.: US 11,545,781 B2
(45) Date of Patent: Jan. 3, 2023

(54) CONNECTOR AND CONNECTION DEVICE FOR ELECTRONIC EQUIPMENT

(75) Inventors: Shinya Yudate, Matsuyama (JP); Masanobu Ozaki, Matsuyama (JP)

(73) Assignee: EX COMPANY LIMITED, Matsuyama (JP)

( * ) Notice: Subject to any disclaimer, the term of this patent is extended or adjusted under 35 U.S.C. 154(b) by 476 days.

(21) Appl. No.: 13/579,403

(22) PCT Filed: Feb. 25, 2011

(86) PCT No.: PCT/JP2011/055008
§ 371 (c)(1),
(2), (4) Date: Aug. 16, 2012

(87) PCT Pub. No.: WO2011/108679
PCT Pub. Date: Sep. 9, 2011

(65) Prior Publication Data

US 2012/0315779 A1 Dec. 13, 2012

(30) Foreign Application Priority Data

Mar. 3, 2010 (JP) ..... JP2010-046103

(51) Int. Cl.
*H01R 13/52* (2006.01)
*H01R 12/72* (2011.01)
(Continued)

(52) U.S. Cl.
CPC ..... *H01R 13/5202* (2013.01); *H01R 12/724* (2013.01); *H01R 13/521* (2013.01); *H01R 13/6581* (2013.01); *H01R 13/6591* (2013.01)

(58) Field of Classification Search
USPC ..... 439/556, 559, 607.58, 271, 272, 274, 439/275, 79
See application file for complete search history.

(56) References Cited

U.S. PATENT DOCUMENTS 3,670,290 A * 6/1972 Angele ..... H01R 12/777 439/271
4,767,350 A * 8/1988 Cooper et al. ..... 439/271
(Continued)

FOREIGN PATENT DOCUMENTS

CN 1819362 A 8/2006
EP 0 827 238 A2 3/1998
(Continued)

OTHER PUBLICATIONS

International Search Report of PCT/JP2011/055008, dated Mar. 29, 2011.

*Primary Examiner* — Felix O Figueroa
(74) *Attorney, Agent, or Firm* — WHDA, LLP

(57) ABSTRACT

The length of a waterproof and dustproof connector can be reduced to decrease its occupation area so as to secure the occupied area of the circuit board for electronic equipment and so as to design the layout of the electronic equipment more freely and so as to downsize the electronic equipment. The connector for electronic equipment includes an approximately cylindrical housing 2, a support 21 provided in the form of a wall in the housing 2, a contact terminal 3 and a power terminal 4 supported by the support 21, a shell 5 mounted inside the housing 2, and a seal 6 provided along the outer circumference adjacent to the end on the connection terminal inserting side of the housing 2. Preferably, the seal 6 is welded to the housing 2 and made of a resin softer than the resin of the housing 2.

5 Claims, 24 Drawing Sheets

(51) Int. Cl.
*H01R 13/6581* (2011.01)
*H01R 13/6591* (2011.01)

(56) References Cited

U.S. PATENT DOCUMENTS

| | | | | |
|---|---|---|---|---|
| 4,960,391 | A * | 10/1990 | Beinhaur et al. | 439/559 |
| 5,277,610 | A | 1/1994 | Krehbiel et al. | |
| 6,467,942 | B2 * | 10/2002 | Alloway et al. | 362/549 |
| 7,229,298 | B2 * | 6/2007 | Shen | H01R 13/658 439/95 |
| 7,329,145 | B2 * | 2/2008 | Yagome et al. | 439/271 |
| 8,092,252 | B2 * | 1/2012 | Peng | 439/559 |
| 8,348,688 | B2 * | 1/2013 | Liu et al. | 439/271 |
| 2002/0119697 | A1 * | 8/2002 | Chan | 439/519 |
| 2002/0155756 | A1 | 10/2002 | Yoshioka | |
| 2005/0054238 | A1 * | 3/2005 | Matkovich et al. | 439/587 |
| 2006/0172592 | A1 | 8/2006 | Takeda et al. | |
| 2008/0048436 | A1 | 2/2008 | Malkovich et al. | |
| 2008/0064260 | A1 | 3/2008 | Mckenzie et al. | |
| 2009/0191927 | A1 | 7/2009 | Hong | |
| 2013/0330951 | A1 * | 12/2013 | Yudate | 439/271 |

FOREIGN PATENT DOCUMENTS

| | | | | |
|---|---|---|---|---|
| EP | 1 100 157 | A2 | 5/2001 | |
| EP | 1 686 663 | A1 | 8/2006 | |
| EP | 2 083 555 | A2 | 7/2009 | |
| JP | 05166563 | A * | 7/1993 | H01R 13/52 |
| JP | 08-315903 | A | 11/1996 | |
| JP | 2002-190346 | A | 7/2002 | |
| JP | 2008-041600 | A | 2/2008 | |
| JP | 2009-176734 | A | 8/2009 | |
| JP | 2010-503178 | A | 1/2010 | |
| WO | 2009/109762 | A1 | 9/2009 | |

* cited by examiner (a)

(b)

(a)

(b)

(a)

(b)

(a)

(b)

CONNECTOR AND CONNECTION DEVICE FOR ELECTRONIC EQUIPMENT

TECHNICAL FIELD

The present invention relates to a connector and a connection device for electronic equipment with a waterproof function such as a connector assembly used for the charger connector of a mobile phone with a waterproof function.

BACKGROUND ART

Conventionally, there is a connector assembly for a mobile phone of PLT 1 as a connection device for electronic equipment with a waterproof function. In the connector assembly of PLT 1, a contact terminal and a grounding terminal are formed in a resin housing by insert molding, a shell is installed at the front of this housing, and an oval collar seal is engaged with a connecting recess formed on the outer circumference of the housing from outside. On the seal disposed at the back of the connector assembly, an airtight recess is formed along the outer circumference of the seal. The respective airtight projections of the bottom and the top cases in which the connector assembly is placed are engaged with the airtight recess. The seal prevents water from being entered from the outside of the shell of this connector assembly while the insert molding prevents water from being entered from the inside of the shell.

CITATION LIST

Patent Literature

PLT1: Japanese Unexamined Patent Application Publication 2009-176734

SUMMARY OF INVENTION

Technical Problem

Since in the connector assembly of PLT 1 the shell is installed at the front of the housing, the length of the connector assembly is longer to have a larger occupied area. Thus, there are problems that lay out of a mobile phone is limited and that downsizing thereof is difficult. Furthermore, since the seal is disposed at the back of the connector assembly, water can penetrate and stand between the connector assembly and the bottom case and between the connector assembly and the top case, and then is more likely to penetrate in the circuit board through the engaged part of the seal.

The present invention is proposed in light of the above-mentioned problems and has an object of providing a connector and a connection device for electronic equipment capable of reducing the length of the connector to decrease its occupation area and then to expand the available portion for the electronic equipment so as to design the layout of the electronic equipment more freely and so as to downsize the electronic equipment. Another object of the present invention is to provide a connector and a connection device for electronic equipment capable of preventing water from penetrating between the case and the connector and more surely preventing water from further penetrating in the circuit board.

The connector for electronic equipment of the present invention includes an approximately cylindrical housing, a support provided in the form of a wall in the housing, a contact terminal and a power terminal supported by the support, a shell mounted inside the housing, and a seal provided along the outer circumference adjacent to the end on the connection terminal inserting side of the housing.

The above-mentioned configuration is capable of reducing the length of the connector to decrease its occupation area and then to expand the available portion for the electronic equipment so as to design the layout of the electronic equipment more freely and so as to downsize the electronic equipment. When the circuit board for a mobile phone is installed in the innermost of the connector, the occupied area of the circuit board for electronic equipment can be secured. Furthermore, a seal is provided adjacent to the end on the connection terminal inserting side of the housing, so that water can be prevented from penetrating between the case and the connector and more surely be prevented from further penetrating in the circuit board.

In the connector for electronic equipment of the present invention, the seal is welded to the housing and made of a resin softer than the resin of the housing.

The above-mentioned configuration can completely prevent water from penetrating between the housing and the seal by welding the housing and the seal. Furthermore, the housing is made of a hard resin while the seal is made of a resin softer than the resin of the housing, so that the shape of the housing can be maintained to improve the workability of the installation operation and the like and so that water can more surely be prevented from penetrating between the case and the seal by the elasticity of the seal.

The connector for electronic equipment of the present invention further includes an additional seal provided in an innermost recess surrounded by the innermost peripheral wall of the housing and the support.

For example, when the contact terminal or the power terminal are not formed in the housing by insert molding, the above-mentioned configuration can more surely prevent water from penetrating in the circuit board installed in the innermost of the connector. In this case, no complex molds are needed to reduce the cost and also the manufacturing failure rate can be reduced, and the flexibility of the shape of the connector can be improved.

In the connector for electronic equipment of the present invention, the seal projects from the end on the connection terminal inserting side of the housing to the connection terminal inserting side and can then be brought into press contact with the face of the connection terminal inserting side of the case in which the housing is placed.

In the above-mentioned configuration, water can be prevented from penetrating in the space between the seal and the case and more surely be prevented from penetrating in the circuit board. Furthermore, the seal is brought into press contact with the face of the connection terminal inserting side, so that fewer parts allow installation by easy vertical motion, for example by inserting a substrate on which the connector is mounted into the bottom case from above.

The connector for electronic equipment of the present invention further includes an elongated protrusion peripherally projecting adjacent to the end on the connection terminal inserting side of the housing and then contacting with the innermost end of the seal, a projection formed on the innermost surface of the elongated protrusion, and a wedge enabling the housing to be biased to the connection terminal inserting side by being pushed to the housing and then contacted with the projection.

In the above-mentioned configuration, the seal can easily be brought into press contact with the surface of the case by the wedge. The press contact state can be further secured to improve the waterproof increasingly. Furthermore, the seal can surely be brought into the press contact state even with no wedges in the case.

The connector for electronic equipment of the present invention includes an elongated protrusion peripherally projecting adjacent to the end on the connection terminal inserting side of the housing and then contacting with the innermost end of the seal, in which an engagement recess is formed on a part of the surface on the connection terminal inserting side of the elongated protrusion and welded to be engaged with the seal, and the seal projects from the end on the connection terminal inserting side of the housing to the connection terminal inserting side and can then be brought into press contact with the face on the connection terminal inserting side of the case in which the housing is placed.

In the above-mentioned configuration, the engagement recess is welded to be engaged with the seal, so that the anchorage strength between the seal and the elongated protrusion that is a part of the housing can be improved. When the seal is brought into press contact with the case, stably maintaining the innermost side of the seal can improve the stability of the waterproof effect by the seal being in the press contact state. Furthermore, the engagement recess partially formed can be used as a filling port when the seal is filled in the mold for formation, so that the manufacturing process can be simplified and made more efficient.

The connection device for electronic equipment of the present invention includes the connector for electronic equipment of the present invention and one and the other cases that form the case, in which the connector includes an elongated protrusion peripherally projecting adjacent to the end on the connection terminal inserting side of the housing and then contacting with the innermost end of the seal, and a projection formed on the innermost surface of the elongated protrusion, one case includes a guide guiding the elongated protrusion to a storage recess toward the connection terminal inserting side along an inclined surface, and the other case includes a wedge enabling the housing to be biased to the connection terminal inserting side by being pushed to the housing side and then contacted with the projection In the configuration, the seal can easily be brought into press contact with the surface of the case by the wedge during the installation of the case. The press contact state can be further secured to improve the waterproof increasingly.

Advantageous Effects of Invention

The connector and the connection device for electronic equipment of the present invention is capable of reducing the length of the connector to decrease its occupation area and then to expand the available portion for the electronic equipment so as to design the layout of the electronic equipment more freely and so as to downsize the electronic equipment. When the circuit board for a mobile phone is installed in the innermost side of the connector, the occupied area of the circuit board for electronic equipment can be secured. The connector and the connection device for electronic equipment of the present invention is capable of preventing water from penetrating between the case and the connector and preventing water from further penetrating in the circuit board.

BRIEF DESCRIPTION OF THE DRAWINGS

FIG. 12(*b*) is a partially cross-sectional side view of FIG. 12(*a*).

FIG. 13(*b*) is a partially cross-sectional side view of FIG. 13(*a*).

FIG. 19(*b*) is a partially cross-sectional side view of FIG. 19(*a*).

FIG. 20(*b*) is a partially cross-sectional side view of FIG. 20(*a*).

FIG. 21(*b*) is a partially cross-sectional side view of FIG. 21(*a*).

FIG. 22(*b*) is a partially cross-sectional side view of FIG. 22(*a*).

FIG. 24(*b*) is a partially cross-sectional side view of FIG. 24(*a*).

FIG. 26(*b*) is a partially cross-sectional side view of FIG. 26(*a*).

DESCRIPTION OF EMBODIMENTS

[The Connector and the Connection Device for Electronic Equipment of the First Embodiment]

Figure 13:
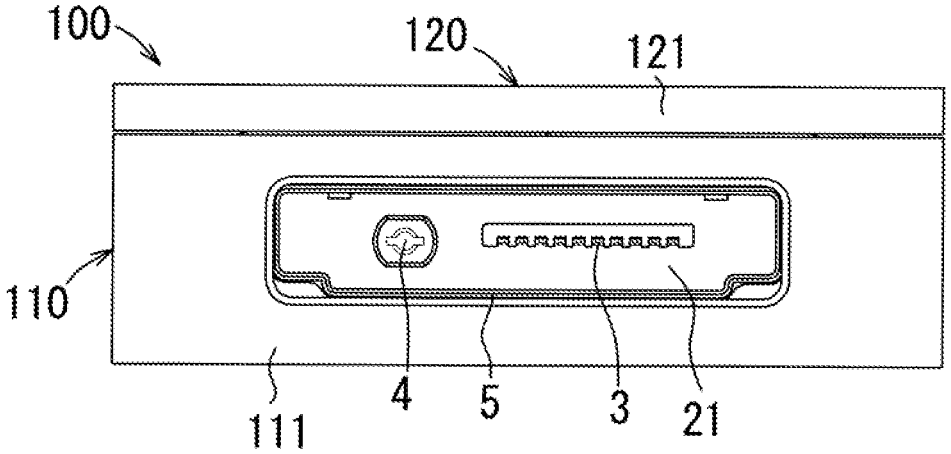
FIG. 13(*a*) is a front view of the connector of the first embodiment, in which a circuit board is mounted and for which the bottom and the top cases are fitted.
Figure 13:
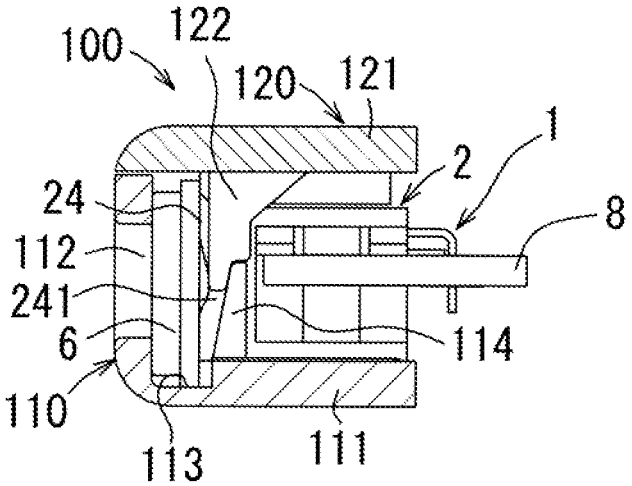
Figure 14:
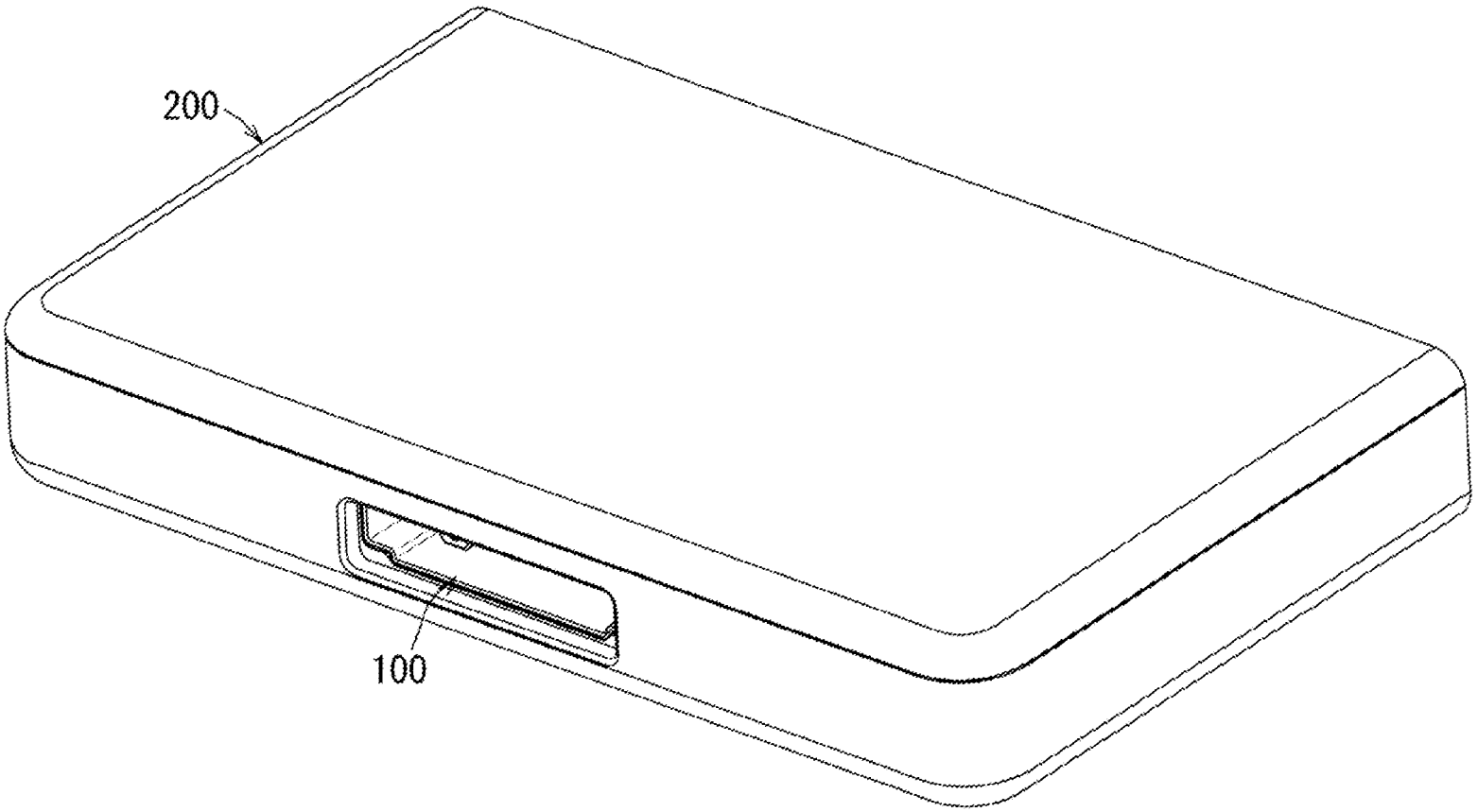
FIG. 14 is a perspective view of the connection device for electronic equipment of the first embodiment, which is mounted in a mobile phone body.
Figure 15:
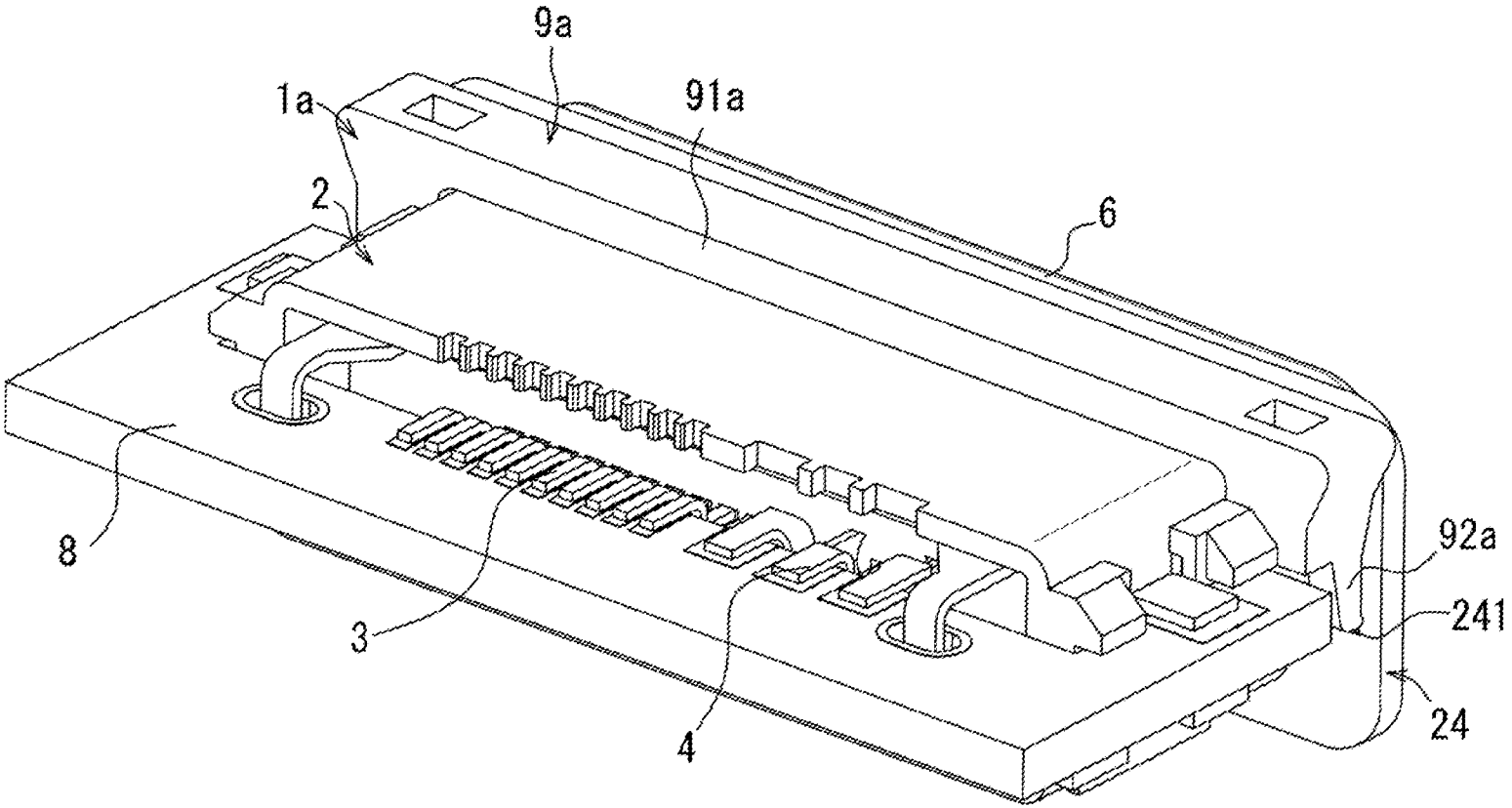
FIG. 15 is a back perspective view of the connector for electronic equipment of the second embodiment according to the present invention, on which a circuit board is mounted.
Figure 16:
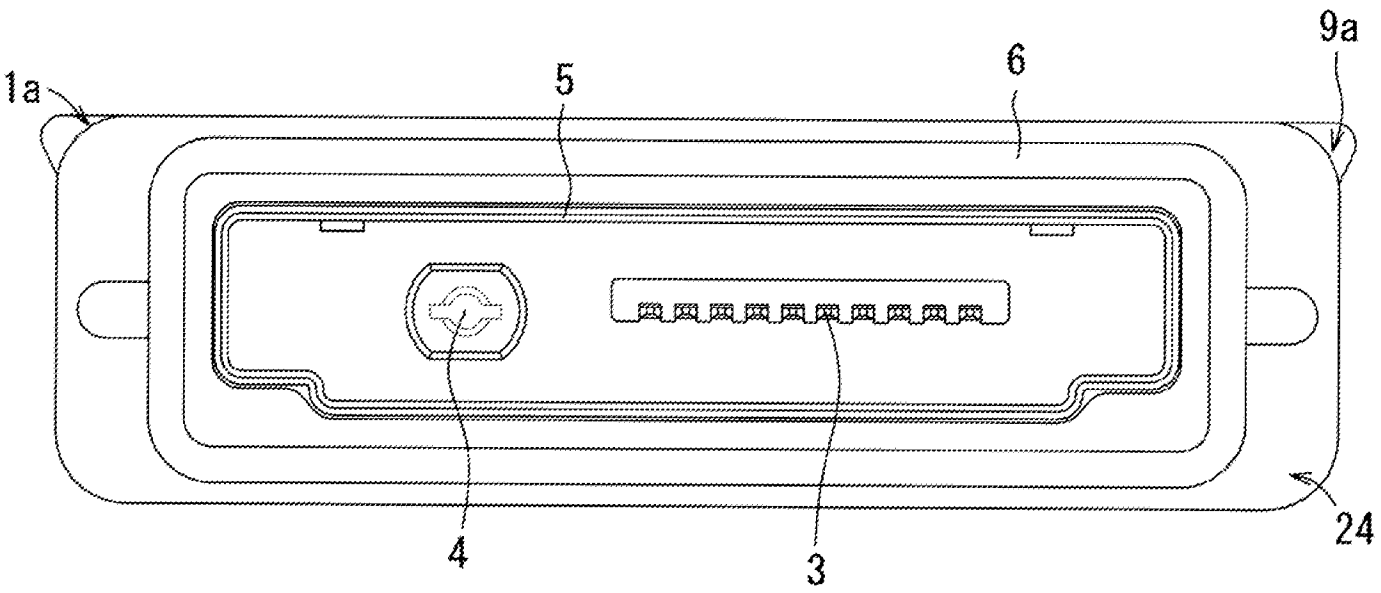
FIG. 16 is a front view of the connector for electronic equipment of the second embodiment according to the present invention.
Figure 17:
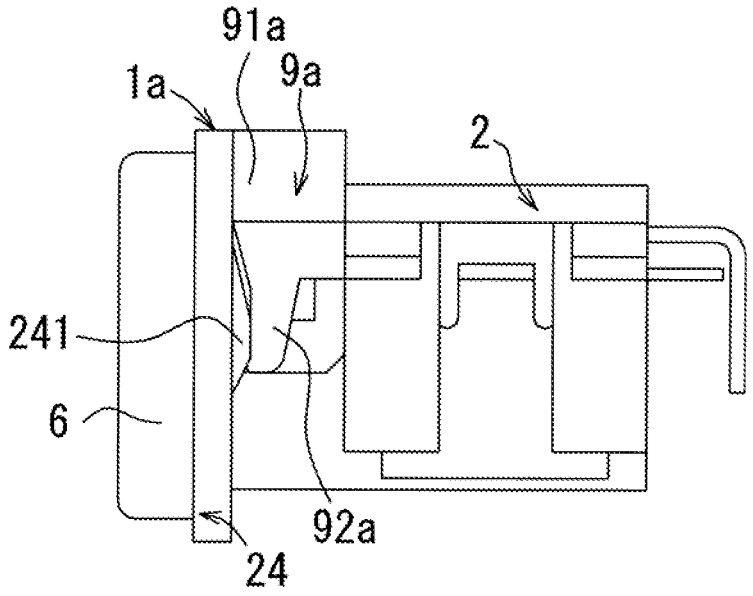
FIG. 17 is a side view of the connector for electronic equipment of the second embodiment according to the present invention.
Figure 18:
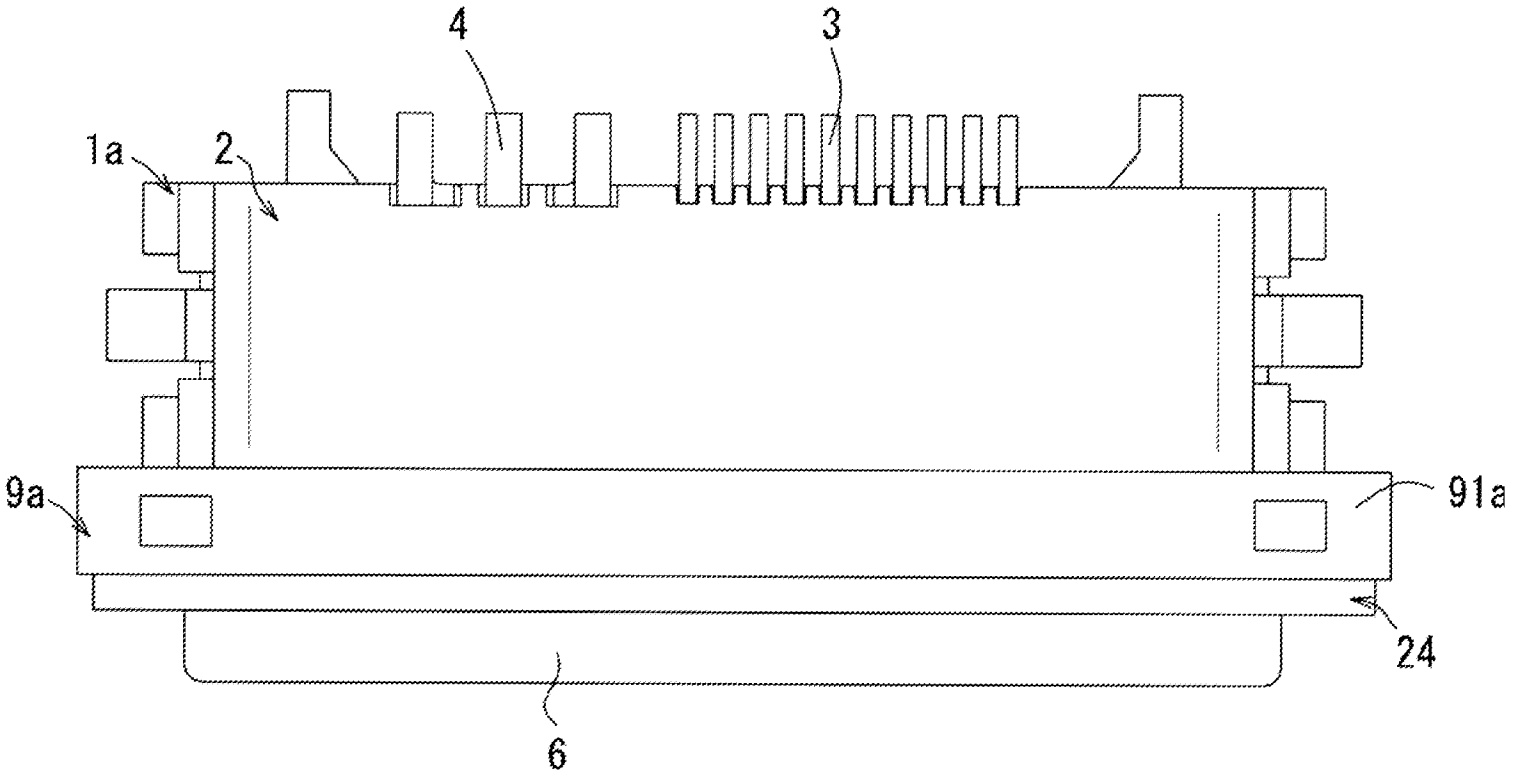
FIG. 18 is a plane view of the connector for electronic equipment of the second embodiment according to the present invention.

The connector and the connection device for electronic equipment of the first embodiment according to the present invention will be explained. FIGS. 1-7 illustrate the connector for electronic equipment of the first embodiment. FIGS. 8-13 illustrate the connection device for electronic equipment of the first embodiment. FIG. 14 illustrates the connection device for electronic equipment of the first embodiment, which is mounted in a mobile phone body.

As shown in FIGS. 1-7, the connector 1 for electronic equipment of the first embodiment is a connector assembly used for the charger connector of a mobile phone and the like, including an approximately cylindrical housing 2, a contact terminal 3 and a power terminal 4 inserted in the innermost of the housing 2, a shell 5 mounted inside the housing 2, and a seal 6 provided along the outer circumference adjacent to the end on the connection terminal inserting side of the housing 2.

The housing 2 is an approximately rectangular cylinder from a front view and formed of a hard resin such as a polyamide resin. In the innermost side in the housing 2, a support 21 is provided in the form of a wall to substantially close the housing 2. Through-holes 22 and 23 are formed in the support 21. The contact terminal 3 and the power terminal 4 are inserted in the through-holes 22 and 23 and are supported by the support 21. The contact terminal 3 and the power terminal 4 supported by the support 21 are inserted into the innermost of the housing 2.

Adjacent to the end on the connection terminal inserting side of the housing 2, an elongated protrusion 24 projects to the periphery and is circumferentially formed. On the right and the left sides of the innermost surface of the elongated protrusion 24, projections 241 are located respectively. Each of the projections has a gentle hill shape with either an inclined surface or a curved surface at least on the top and projects backward. The innermost end of the seal 6 described below is contacted with the surface of the connection terminal inserting side of the elongated protrusion 24. Engagement recesses 242 are formed on the respective parts of the right and the left sides of the surface on the connection terminal inserting side of the elongated protrusion 24. A part of the seal 6 is inserted in the engagement recesses 242 and then is fixed.

The shell 5 is a metallic, approximately rectangular cylinder, the outside dimension of which is the same as or slightly smaller than the inside dimension of the housing 2, and placed in the housing 2. The joint groove 243 is formed along the periphery on the connection terminal inserting side of the support 21. The innermost end of the shell 5 is fitted and installed on the joint groove 243.

The seal 6 is formed with a soft resin such as an elastomer softer than the resin of the housing 2 and welded to the housing 2. The interface between the seal and the housing 2 is melted to be integrated. The seal 6 is welded along the outer circumference adjacent to the end on the connection terminal inserting side of the housing 2 and projects from the end on the connection terminal inserting side of the housing 2 to the connection terminal inserting side. The projecting portion of this seal 6 can be brought into press contact with the surface on the connection terminal inserting side of the case in which the housing 2 is placed. The innermost end of the seal 6 is welded in contact with the surface on the connection terminal inserting side of the elongated protrusion 24. A part of the seal 6 is inserted in the engagement recesses 242 and then is welded.

Figure 1:
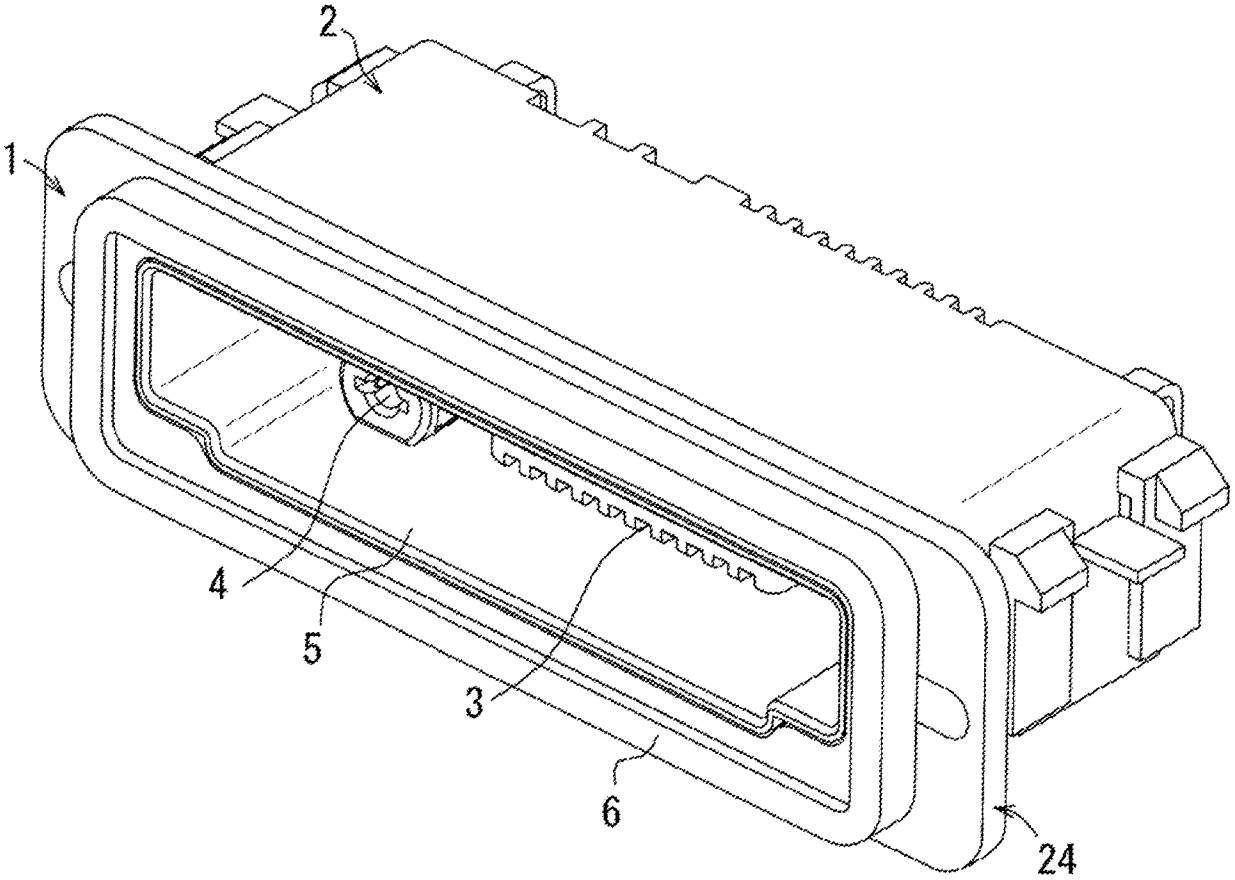
FIG. 1 is a front perspective view of the connector for electronic equipment of the first embodiment according to the present invention.
Figure 2:
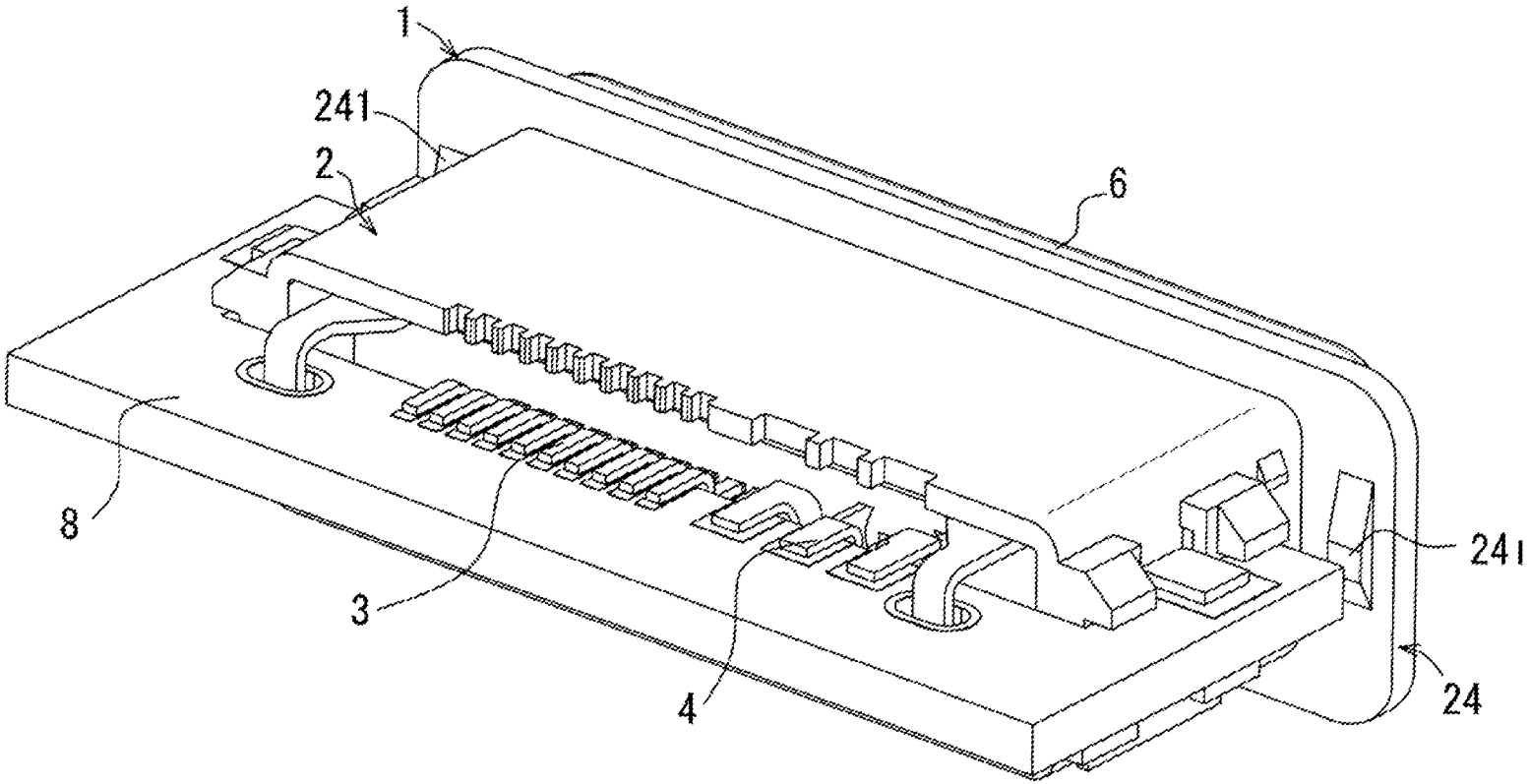
FIG. 2 is a back perspective view of the connector for electronic equipment of the first embodiment, in which a circuit board is mounted.
Figure 3:
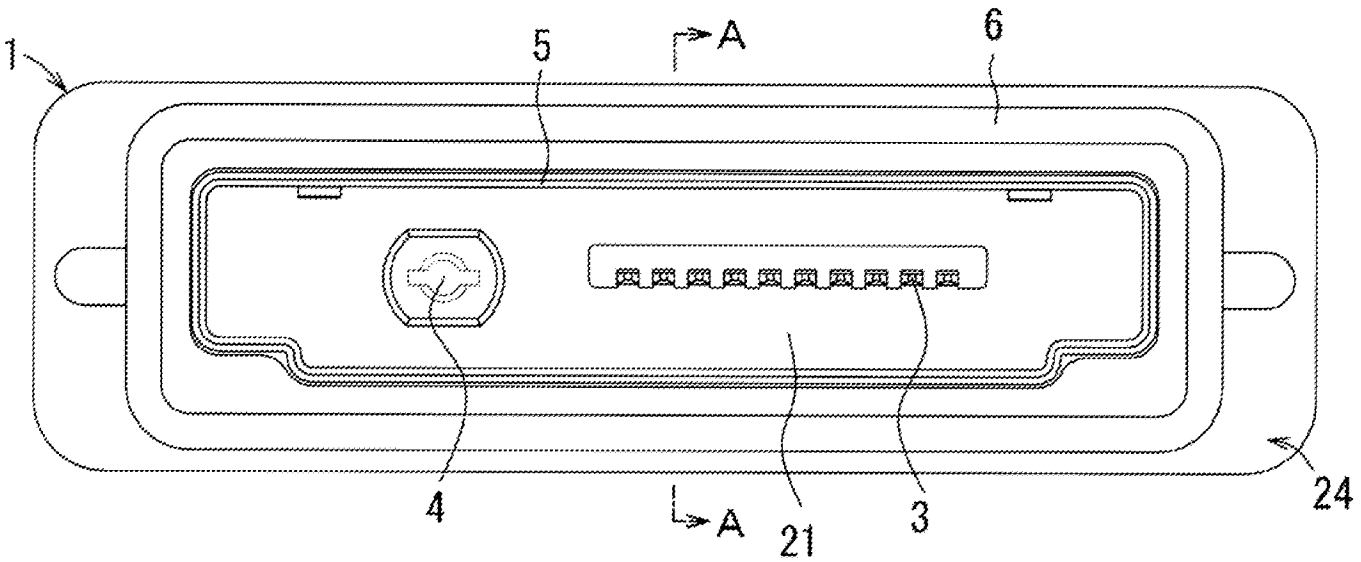
FIG. 3 is a front view of the connector for electronic equipment of the first embodiment according to the present invention.
Figure 4:
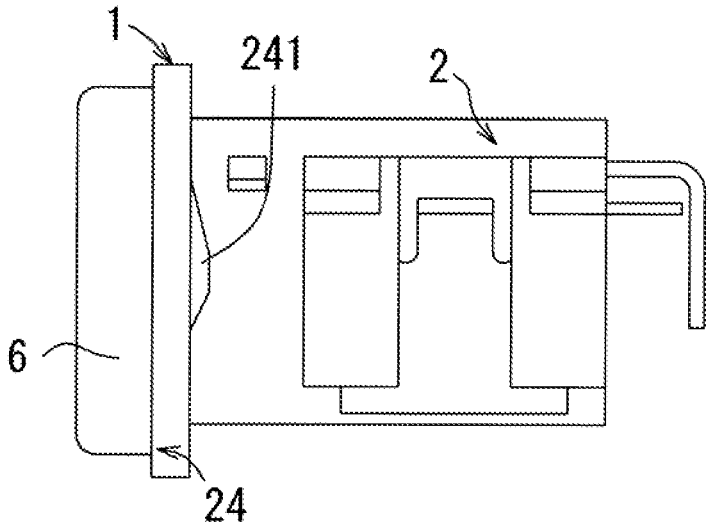
FIG. 4 is a side view of the connector for electronic equipment of the first embodiment according to the present invention.
Figure 5:
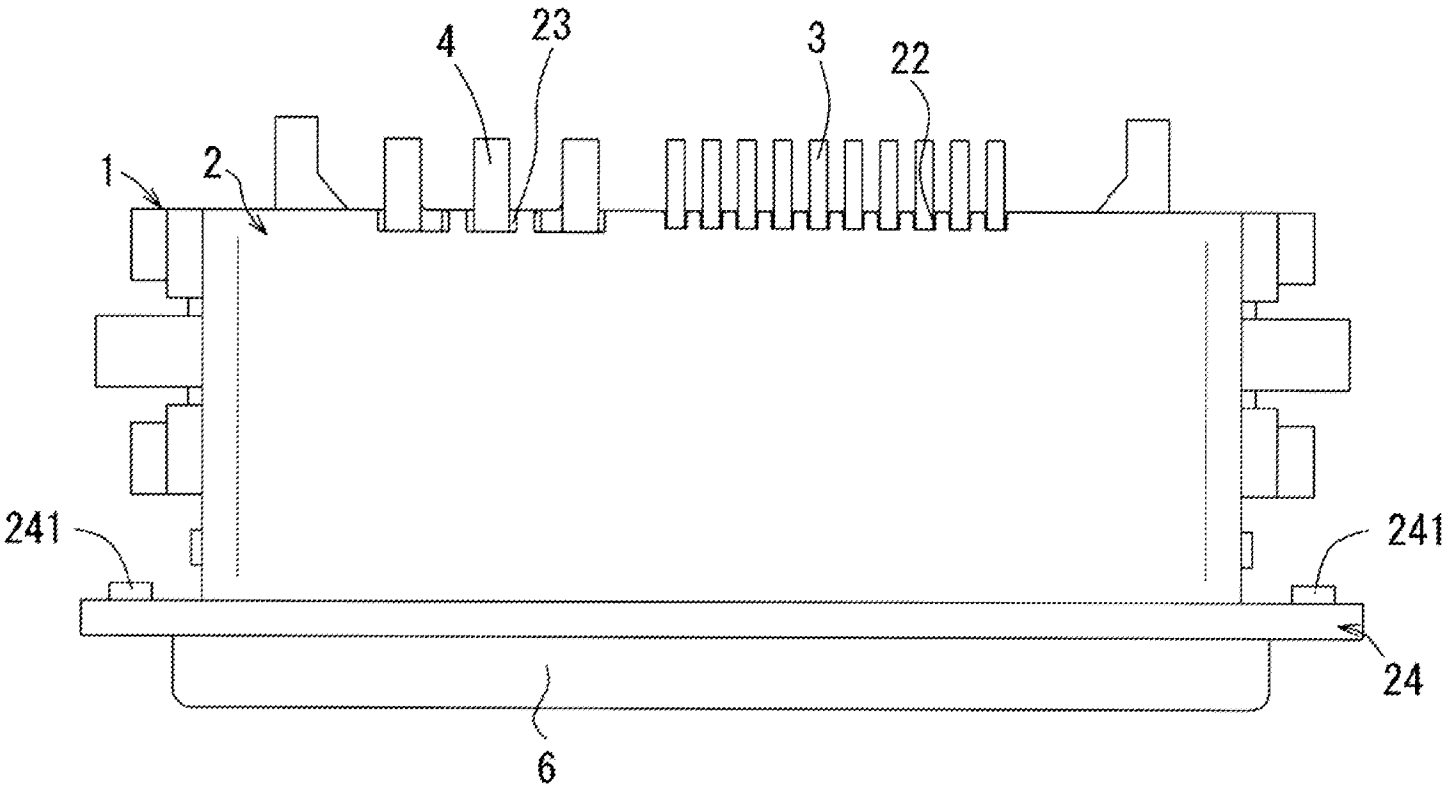
FIG. 5 is a plane view of the connector for electronic equipment of the first embodiment according to the present invention.
Figure 6:
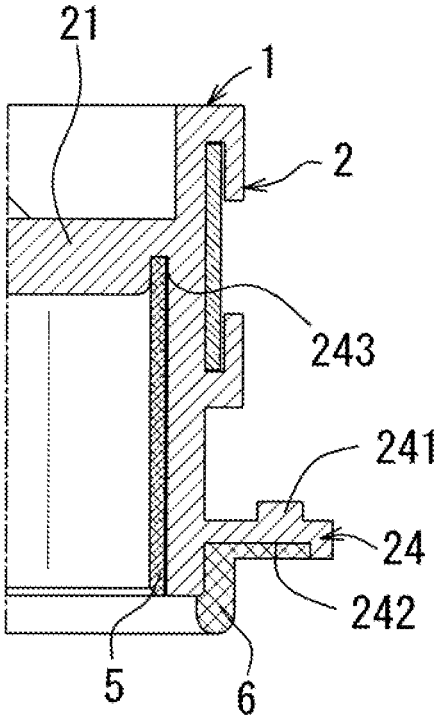
FIG. 6 is a partially cross-sectional plane view of FIG. 3.
Figure 7:
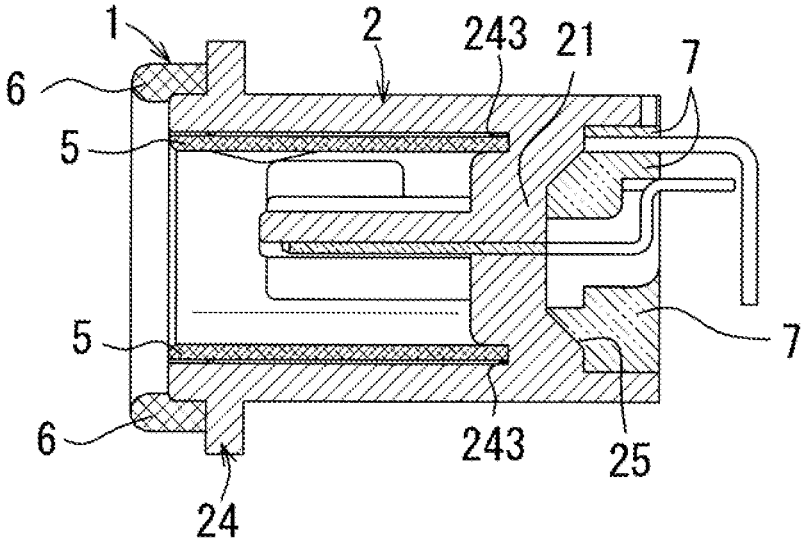
FIG. 7 is a cross-sectional view along the line A-A of FIG. 3.
Figure 8:
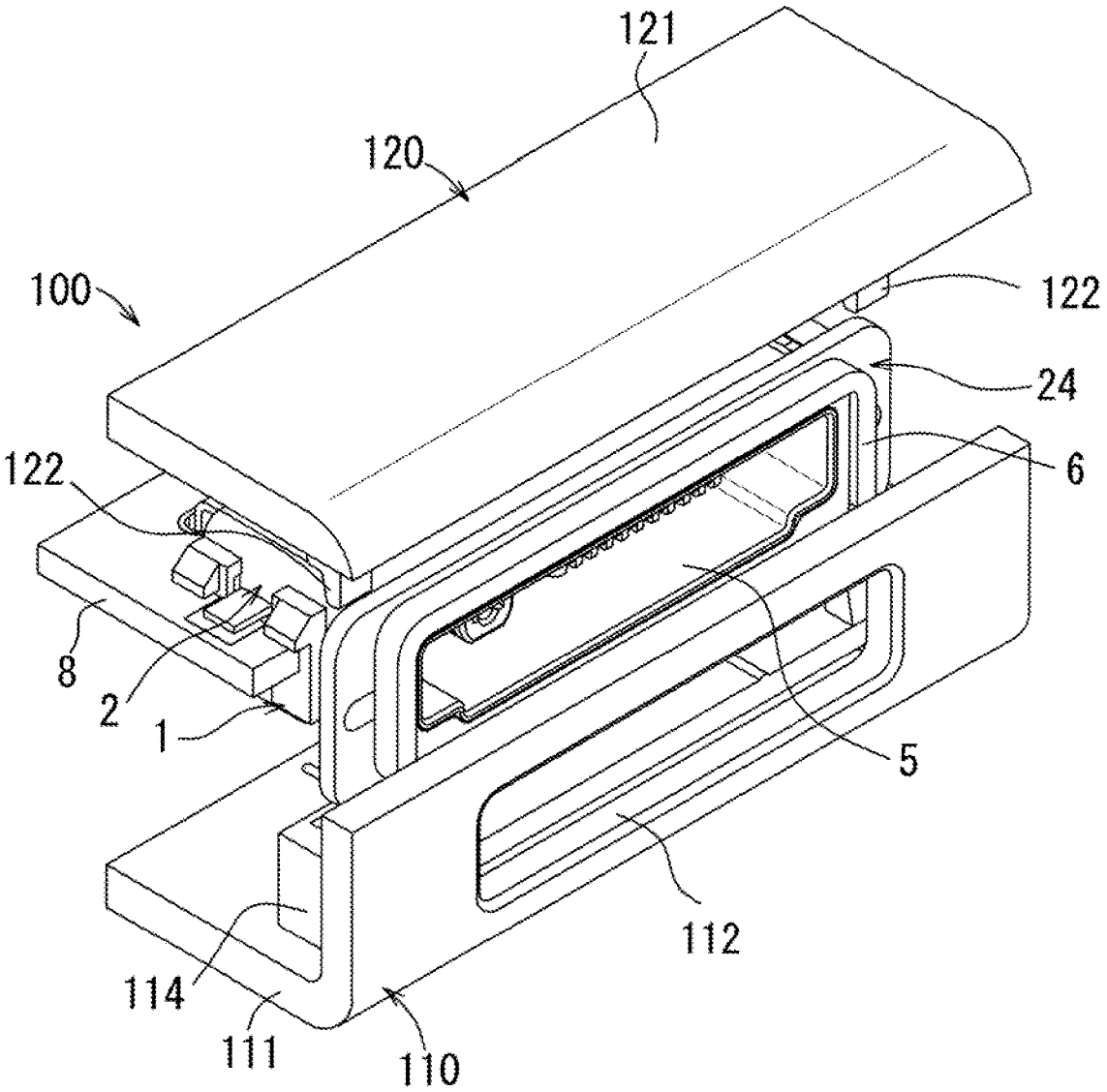
FIG. 8 is a perspective view of the connector of the first embodiment, in which a circuit board is mounted and for which the bottom and the top cases are placed.
Figure 9:
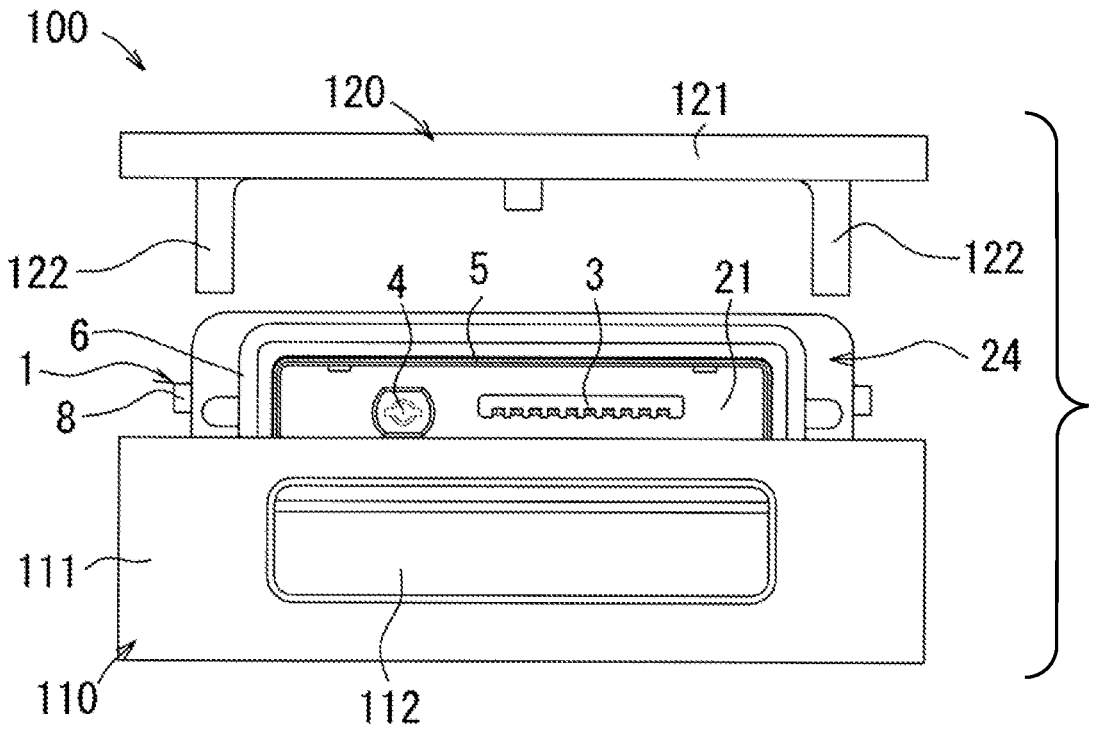
FIG. 9 is a front view of FIG. 8.
Figure 10:
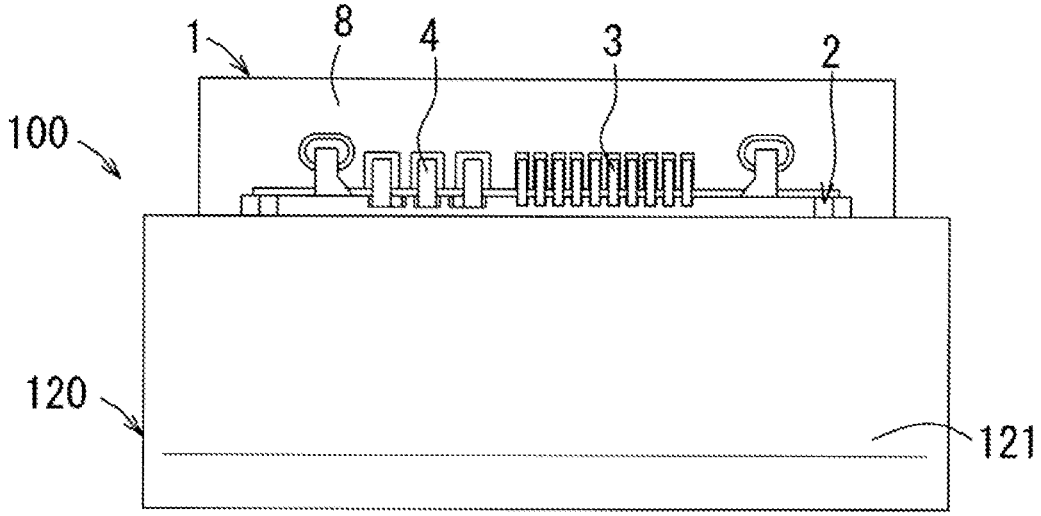
FIG. 10 is a plane view of FIG. 8.
Figure 11:
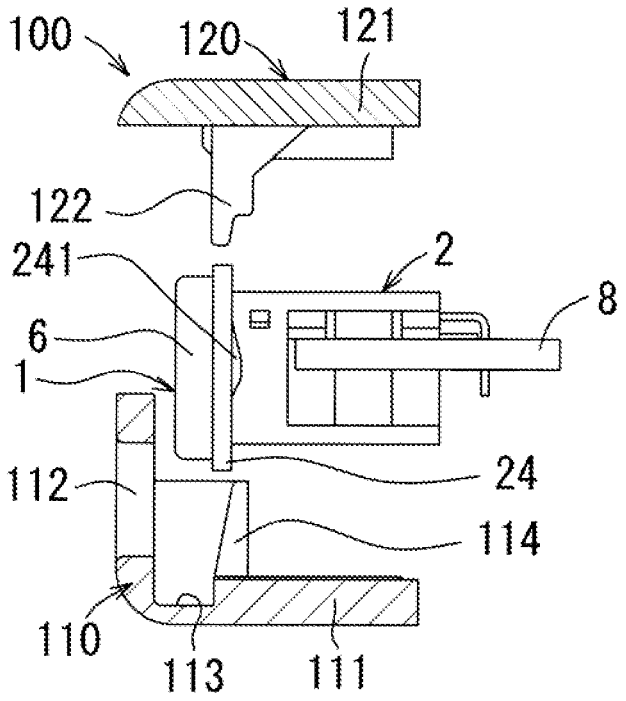
FIG. 11 is a partially cross-sectional side view of FIG. 9.

As shown with two-dot chain lines of FIG. 7, in the innermost recess 25 surrounded by the innermost peripheral wall of the housing 2 and the support 21, another seal 7 such as an adhesive e.g. a bond is filled. When the contact terminal 3 and the power terminal 4 are formed in the housing 2 by insert molding, another seal 7 may not be provided.

As shown in FIGS. 2 and 8-13, a circuit board 8 is disposed in the innermost of the connector 1 and is electrically connected with the contact terminal 3 and the power terminal 4 introduced from the innermost of the housing 2 respectively. The circuit board 8 of this embodiment has an approximate c-shape from a plane view and is disposed in the innermost of the housing 2 across from the right to left sides.

The connector 1 is placed in a case to form the connection device 100 as shown in FIGS. 8-13. The case of this embodiment is composed of a bottom case 110 that is the first case and a top case 120 that is a second case. The most part of the connector 1 is accommodated between the bottom case 110 and the top case 120.

The bottom case 110 includes a plate-like body 111 with an approximate L-shape from a cross-sectional view, an aperture 112 formed on the front surface of the body 111 for inserting the connection terminal, a storage recess 113 in which the lower part of the elongated protrusion 24 and the seal 6 of the connector 1 are stored, and a pair of guides 114 formed at a position near the right and the left sides of the body 111 for guiding the elongated protrusion 24 to the storage recess 113 toward the connection terminal inserting (front) side along the inclined surface. The top case 120 includes a plated body 121 with an approximately rectangular shape from a plane view, and a pair of wedges 122 projecting downward at a position near the right and the left sides of the back surface of the body 121.

Figure 12A:
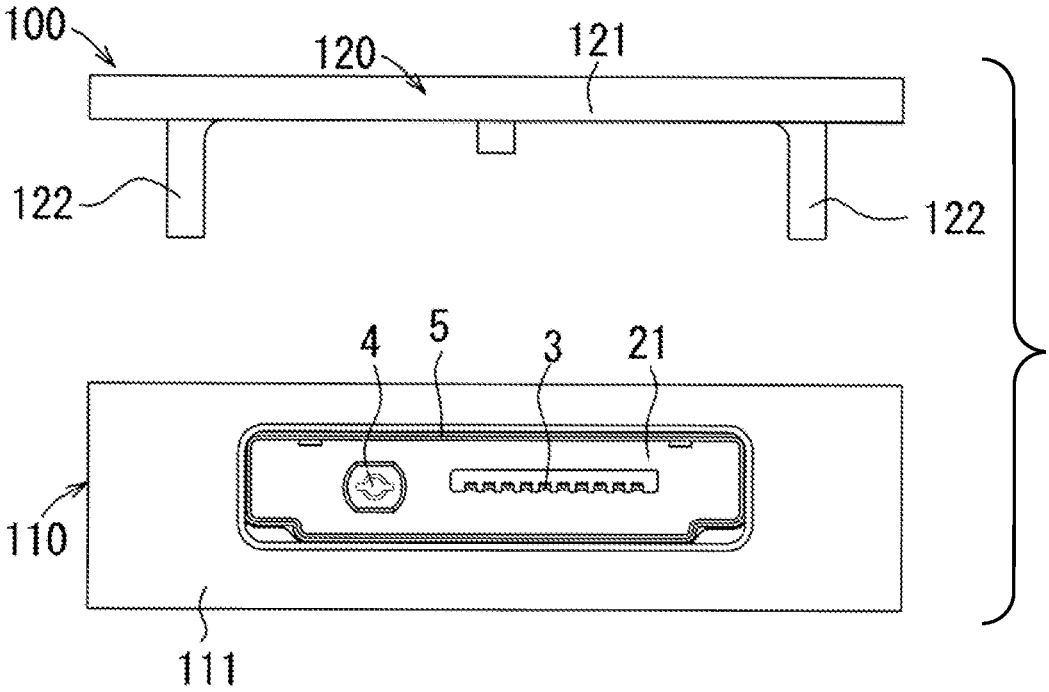
FIG. 12(*a*) is a front view of the connector of the first embodiment, in which a circuit board is mounted and for which the bottom case is fitted and the top case is placed.
Figure 12B:
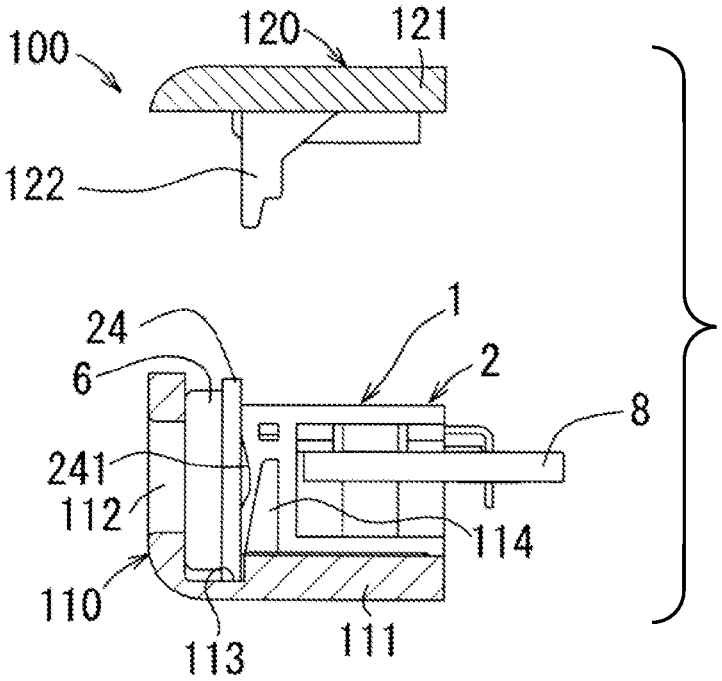

As shown in FIG. 12*b*, in the connector 1, the elongated protrusion 24 and the seal 6 are stored in the storage recess 113 by sliding the elongated protrusion 24 in contact with the forwardly inclined surface and downward of the lower part of the guide 114, and then installed in the bottom case 110. As shown in FIG. 13, the top case 120 is pushed to the housing 2 side from above. Then, a pair of wedges 122 at the positions respectively corresponding to a pair of guides 114 and a pair of projections 241 is inserted between the corresponding guide 114 and the corresponding projection 241 and then pressed in contact with the corresponding projection 241. Accordingly, the housing 2 is biased to the connection terminal inserting side to bring the end on the connection terminal inserting side of the seal 6 into press contact with the front surface of the bottom case 110. In the above-mentioned configuration, the entire aperture 112 for inserting the connection terminal is continuously formed as an aperture on the front surface of the bottom case 110. If the respective recesses of the top and the bottom cases are matched and then an aperture is formed, water may enter from the matched part. In contrast, in the present invention, the entire aperture formed on one case or the other case for inserting the connection terminal and the configuration accomplished by the above-mentioned press contact state ensure the waterproof effect.

The connection device 100 for electronic equipment is used as, for example, a charger connector of a mobile phone body 200 shown in FIG. 14.

In the connector 1 and the connection device 100 for electronic equipment of the first embodiment, the seal 6 is provided adjacent to the end on the connection terminal inserting side of the housing, so that the length of the connector 1 can be reduced to decrease its occupation area and then to expand the available portion for the electronic equipment, so as to secure the occupied area of the circuit board 8 installed in the innermost of the connector and so as to design the layout of the electronic equipment more freely and so as to downsize the electronic equipment. Furthermore, water can be prevented from penetrating between the case and the connector 1 and more surely be prevented from further penetrating in the circuit board 8.

Water can completely be prevented from penetrating between the housing 2 and the seal 6 by welding the housing and the seal 6. Furthermore, the housing 2 is made of a hard resin while the seal 6 is made of a soft resin softer than the resin of the housing 2, so that the shape of the housing 2 can be maintained to improve the workability of the installation operation and the like and so that water can more surely be prevented from penetrating between the case and the seal 6 by the elasticity of the seal 6. For example, when the contact terminal or the power terminal is not formed in the housing 2 by insert molding but when the another seal 7 is provided, water can be more surely prevented from penetrating in the circuit board installed in the innermost of the connector 1. In this case, no complex molds are needed to reduce the cost and the manufacturing failure rate can be reduced, and the flexibility of the shape of the connector 1 can be improved.

The seal 6 is welded to be engaged with the engagement recess 242, so that the anchorage strength between the seal 6 and the elongated protrusion 24 that is a part of the housing 2 can be improved. When the seal 6 is brought into press contact with the case, stably maintaining the innermost of the seal 6 can improve the stability of the waterproof effect by the seal 6 being in the press contact state. Furthermore, the engagement recess 242 can be used as a filling port when the seal 6 is filled in the mold, so that the manufacturing process can be simplified and made more efficient. The seal 6 can easily be brought into press contact with the surface of the case by the wedge during installation and also the press contact state can be further secured to improve the waterproof increasingly. Furthermore, the seal 6 is brought into press contact with the face of the connection terminal inserting side, so that fewer parts allow installation by easy vertical motion, for example by inserting a substrate on which the connector is mounted into the bottom case 110 from above.

[Connector and Connection Device for Electronic Equipment of the Second Embodiment]

The connector and the connection device for electronic equipment of the second embodiment according to the present invention will be explained. The same description as that of the first embodiment will not be explained in particular. FIGS. 15-18 illustrate the connector for electronic equipment of the second embodiment. FIGS. 19-22 illustrate the connection device for electronic equipment of the second embodiment. As shown in FIGS. 15-18, the connector 1*a* for electronic equipment of the second embodiment includes a housing 2, a contact terminal 3, a power terminal 4, a shell 5, a seal 6, and an another seal 7, the configuration of which are the same as that of the first embodiment, in which a circuit board 8, the configuration of which is the same as that of the first embodiment, is installed. However, in the connector 1*a*, a wedge member 9*a* with an approximate c-shape from a front view is provided independently from a case and engaged with the housing 2 in the innermost of the elongated protrusion 24 from above. In the wedge member 9*a*, wedges 92*a* are formed at both ends of a rod-shaped base body 91*a* respectively. The wedges 92*a* are disposed to positions respectively corresponding to projections 241 located at the both sides.

The connector 1*a* is placed in a case to form the connection device 100*a* as shown in FIGS. 19-22. The case of this present embodiment is composed of a bottom case 110, the configuration of which is the same as that of the first embodiment, and the top case 120*a* that is the second case. In the top case 120*a*, the wedge 122 is removed from the top case 120 of the first embodiment.

Figure 19A:
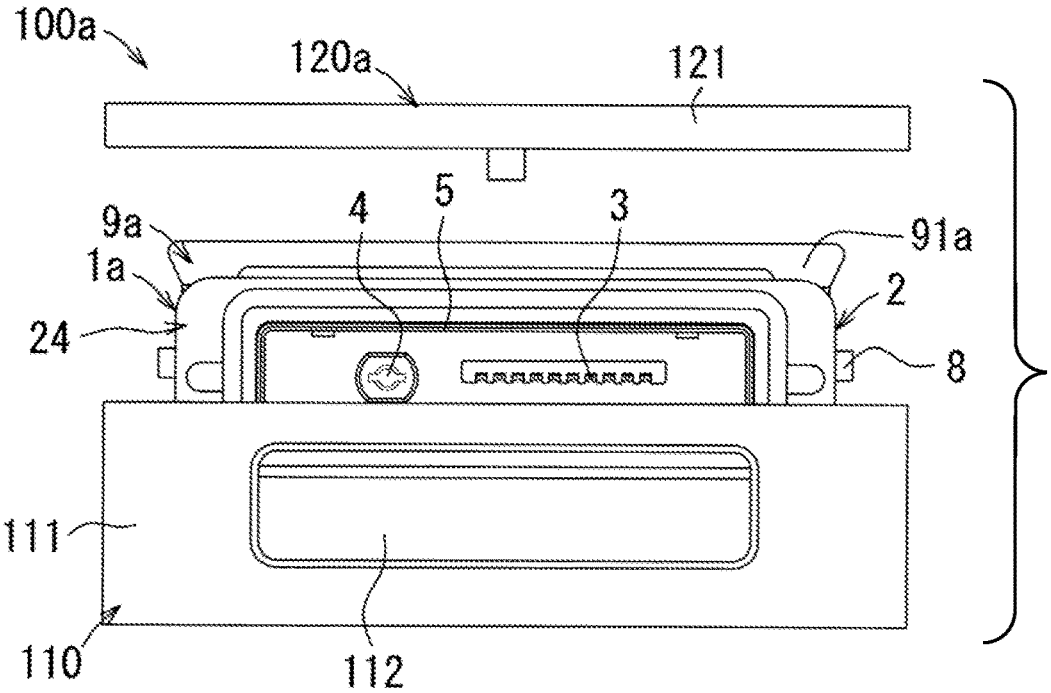
FIG. 19(*a*) is a front view of the connector of the second embodiment, in which a circuit board is mounted and for which the bottom and the top cases are placed.
Figure 19B:
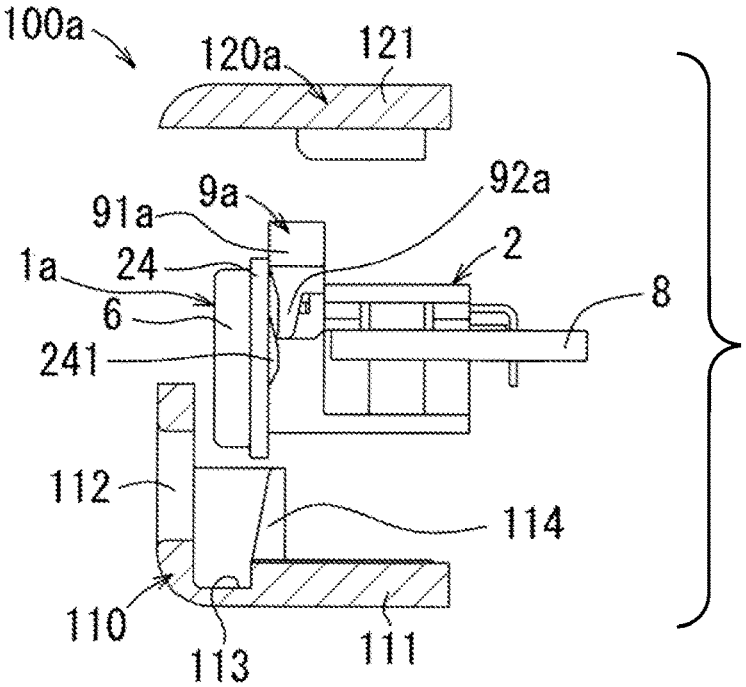
Figure 20A:
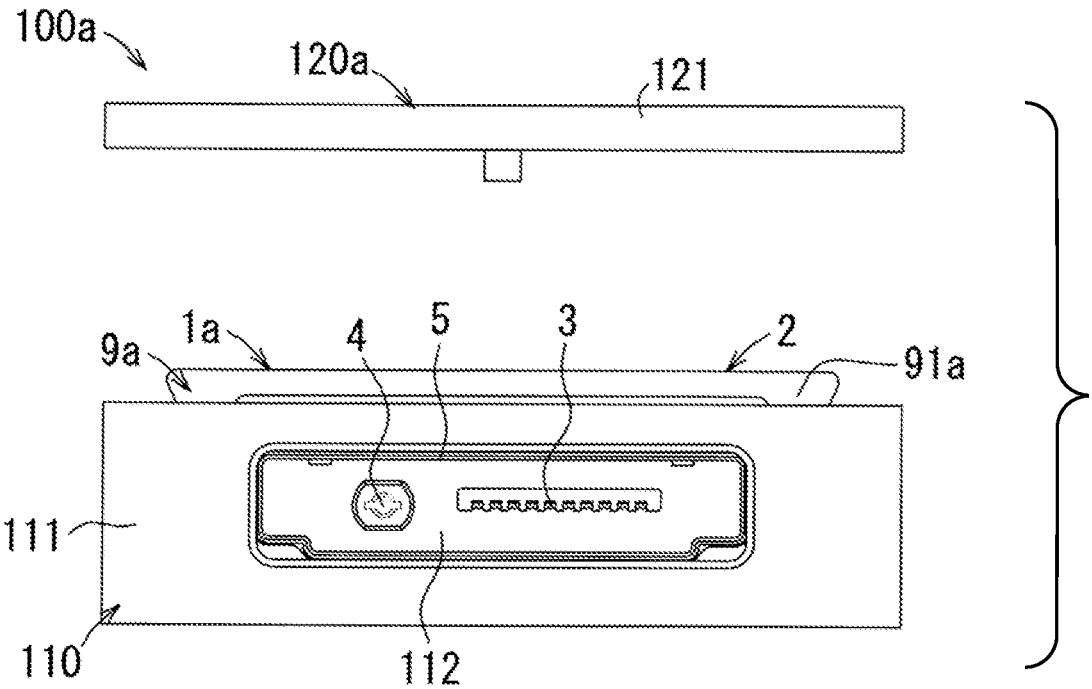
FIG. 20(*a*) is a front view of the connector of the second embodiment, in which a circuit board is mounted and for which the bottom is fitted and the top case is placed.
Figure 20B:
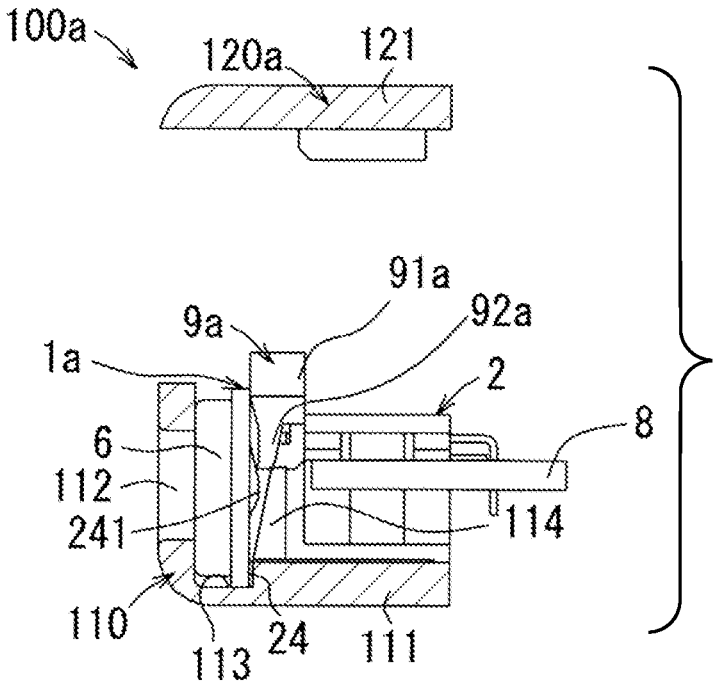
Figure 21A:
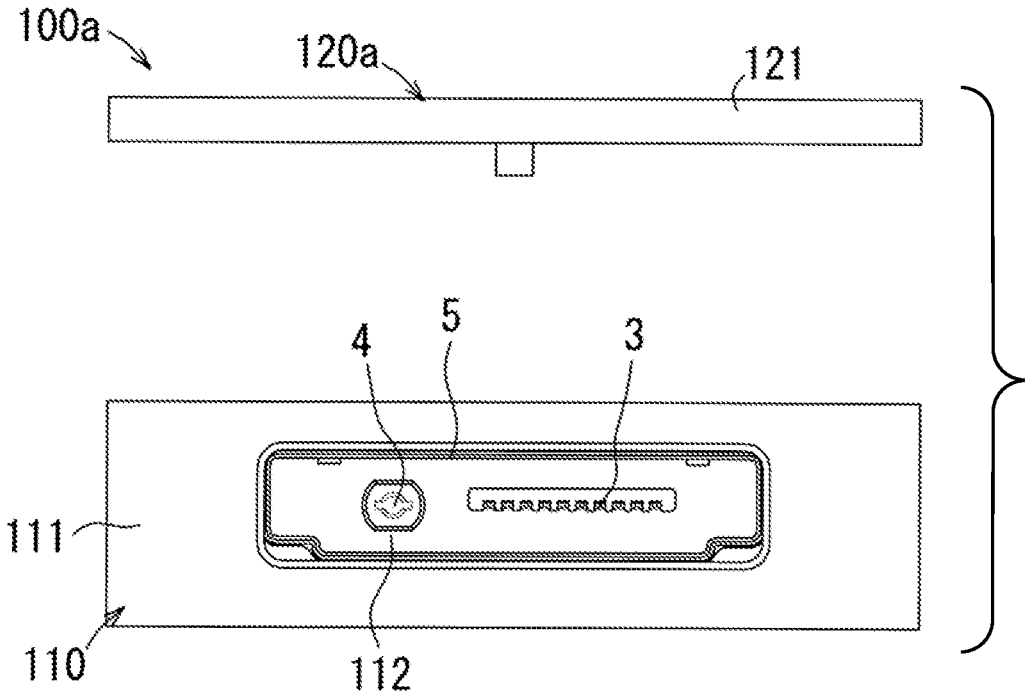
FIG. 21(*a*) is a front view of FIG. 19(*a*), in which the wedge member is pushed.
Figure 21B:
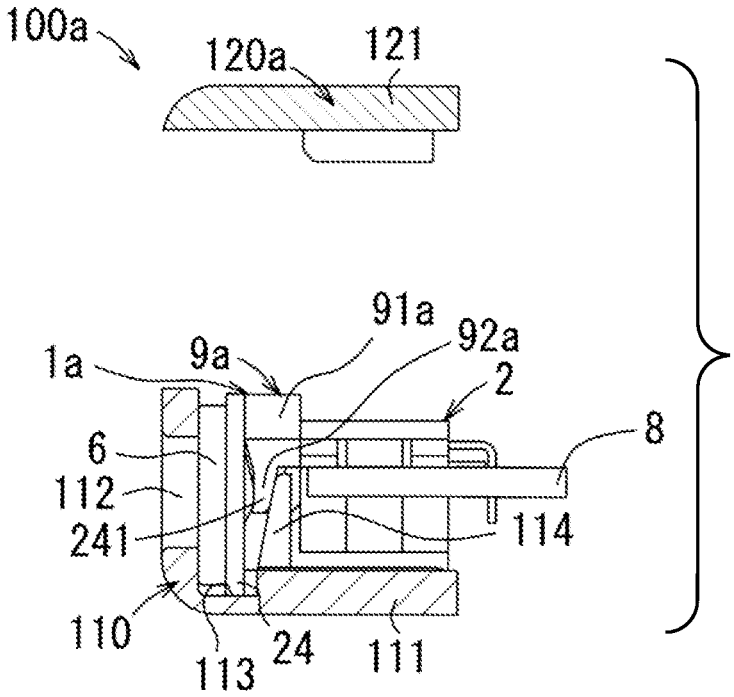
Figure 22:
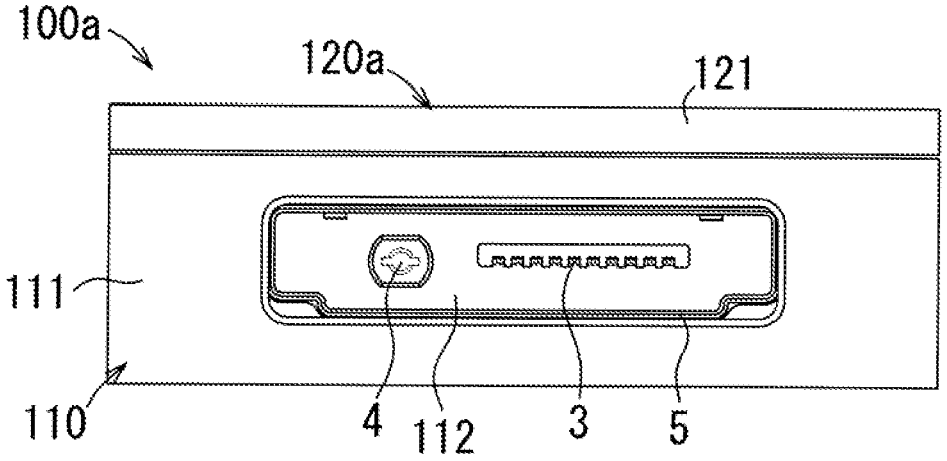
FIG. 22(*a*) is a front view of the connector of the second embodiment, in which a circuit board is mounted and for which the bottom and the top cases are fitted.
Figure 22:
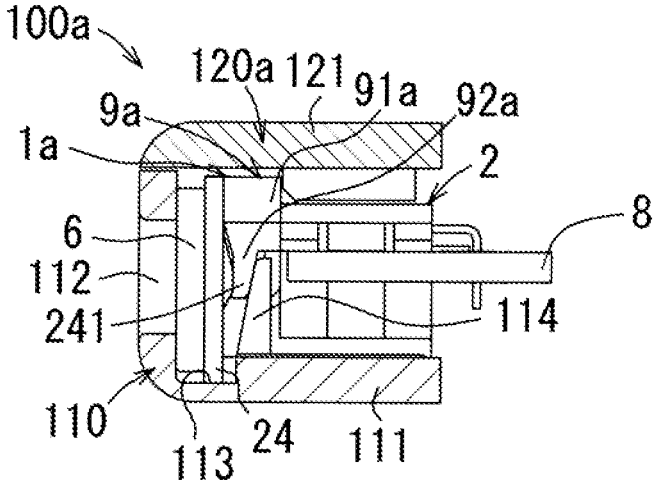

In the same way as the first embodiment, in the connector 1*a*, the elongated protrusion 24 and the seal 6 are stored in the storage recess 113 by sliding the elongated protrusion 24 in contact with the forwardly inclined surface inclining forward and toward the lower part of the guide 114, and then installed in the bottom case 110 (see FIGS. 19*b* and 20*b*). As shown in FIG. 21*b*, the wedge member 9*a* is pushed to the housing 2, and then a pair of wedges 92*a* at the positions respectively corresponding to a pair of guides 114 and a pair of projections 241 is inserted between the corresponding guide 114 and the corresponding projection 241 and then pressed in contact with the corresponding projection 241. Accordingly, the housing 2 is biased to the connection terminal inserting side to bring the end on the connection terminal inserting side of the seal 6 into press contact with the front surface of the bottom case 110.

Then, the top case 120*a* is disposed on the top surface of the housing 2 to form the connection device 100*a*. The wedge member 9 can be pressed in contact with the projection 241 by pushing the top case 120*a* to the housing 2 side from above then to make the wedge members 92*a* to be pushed.

In the second embodiment, the seal 6 can easily be brought into press contact with the surface of the case by the independently provided wedge member 9*a*. The press contact state can be further secured to improve the waterproof increasingly. Furthermore, the seal 6 can surely be brought into the press contact state even with no wedges 122 in the case. This embodiment has a corresponding effect based on the same configuration as that of the first embodiment.

[Connector and Connection Device for Electronic Equipment of the Third Embodiment]

Figure 23:
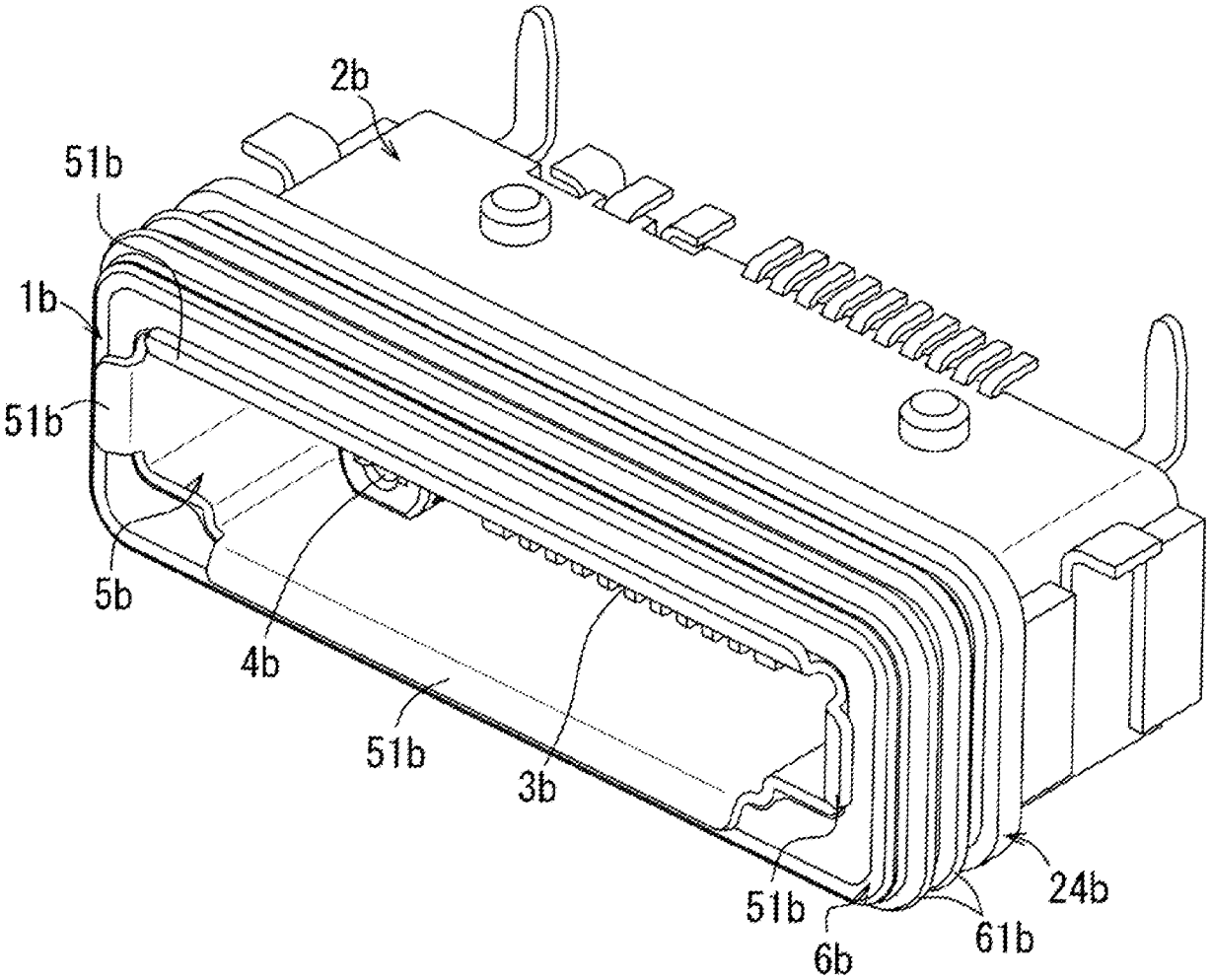
FIG. 23 is a front perspective view of the connector for electronic equipment of the third embodiment according to the present invention.
Figure 24:
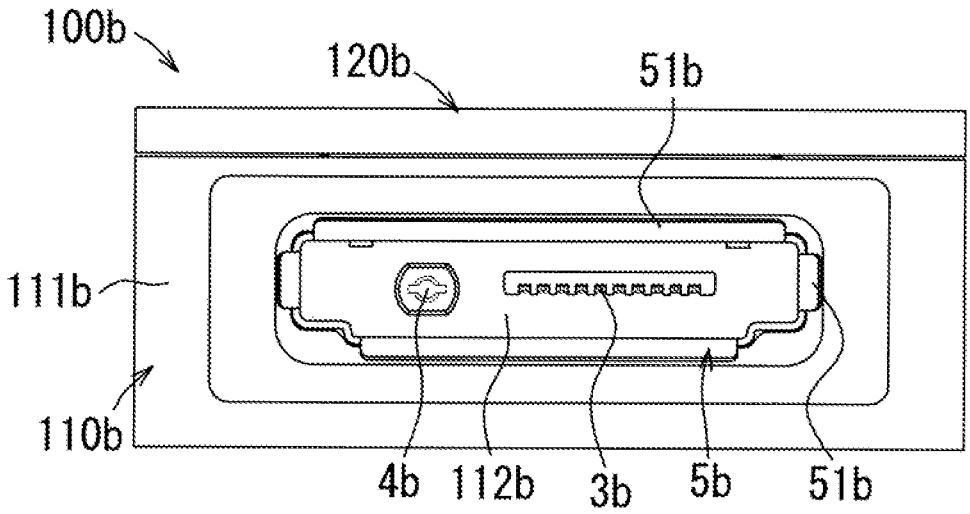
FIG. 24(*a*) is a front view of the connector of the third embodiment, in which a circuit board is mounted and for which the bottom and the top cases are fitted.
Figure 24:
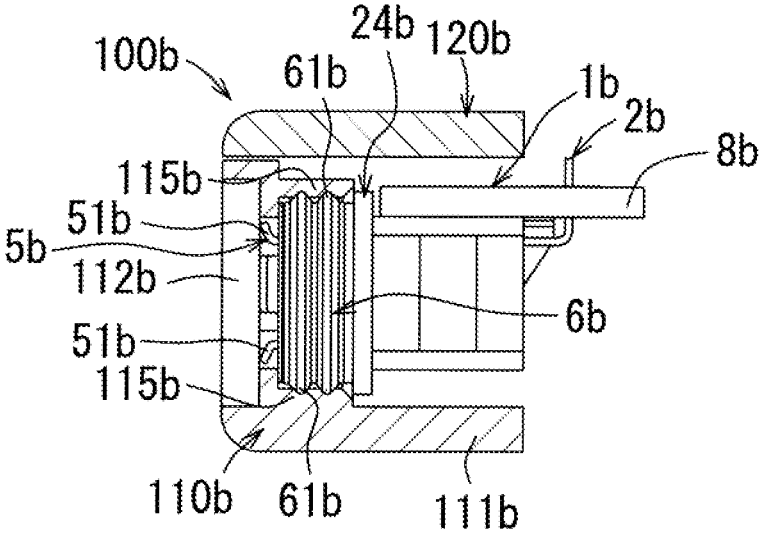

The connector and the connection device for electronic equipment of the third embodiment according to the present invention will be explained. The same description as that of the first embodiment will not be explained in particular. FIG. 23 illustrates the connector for electronic equipment of the third embodiment. FIG. 24 illustrates the connection device for electronic equipment of the third embodiment.

As shown in FIGS. 23 and 24, the connector 1*b* for electronic equipment of the third embodiment is a connector assembly used for the charger connector of a mobile phone and the like, including an approximately cylindrical housing 2*b*, a contact terminal 3*b* and a power terminal 4*b* introduced to the innermost of the housing 2*b*, a shell 5*b* mounted inside the housing 2*b*, and a seal 6*b* provided along the outer circumference adjacent to the end on the connection terminal inserting side of the housing 2*b*.

Adjacent to the end on the connection terminal inserting side of the housing 2*b*, an elongated protrusion 24*b* projects to the periphery and is circumferentially formed at a position further inside from the elongated protrusion 24 of the first embodiment. The length of the end of the housing 2*b* located at the end on the connection terminal inserting side is longer than that of the elongated protrusion 24*b*. The projection 241 or the engagement recess 242 of the first embodiment is not formed on the elongated protrusion 24*b*. The innermost end of the seal 6*b* described below is contacted with the surface of the connection terminal inserting side of the elongated protrusion 24*b*. The remaining parts of the configuration of the housing 2*b* are the same as those of the housing 2 of the first embodiment. Furthermore, the shell 5*b* is the same as the shell 5 of the first embodiment except that the shell 5*b* has bending tabs 51*b* bending outward at the connection terminal inserting side.

The seal 6*b* is formed with a soft resin such as an elastomer softer than the resin of the housing 2*b*, and welded to the housing 2*b*. The interface between the seal and the housing 2*b* is melted to be integrated. The seal 6*b* is welded to the outer circumference adjacent to the end on the connection terminal inserting side of the housing 2*b*. The end on the connection terminal inserting side extends to the approximate tip of the end of the housing 2*b*. The innermost end is welded in contact with the surface of the connection terminal inserting side of the elongated protrusion 24*b*. Furthermore, a plurality of (two in this example) peripheral projections 61*b* projecting outward are provided on the seal 6*b*. A circuit board 8*b* having an approximately rectangular shape from a plane view is disposed on the upper part of the connector 1*b* and is electrically connected with the contact terminal 3*b* and the power terminal 4*b* introduced from the innermost of the housing 2*b*. Another seal 7 of the first embodiment may be provided if necessary. The connector 1*b* is placed in a case to form the connection device 100*b*. The case of this embodiment is composed of a bottom case 110*b* that is one case and a top case 120*b* that is the other case. The most part of the connector 1*b* is accommodated between the bottom case 110*b* and the top case 120*b*.

The bottom case 110*b* includes a plate-like body 111*b* with an approximate L-shaped from a cross-sectional view, an aperture 112*b* formed on the front surface of the body 111*b* for inserting the connection terminal, and a seal socket 115*b* projecting circumferentially and being formed from the front surface to the innermost of the body 111*b*. The top case 120*b* is formed in the form of an approximately rectangular plate from a plane view.

In the connector 1*b*, the seal 6*b* is inserted into the seal socket 115*b*. Then, the seal 6*b*, especially the peripheral projection 61*b*, is brought into press contact with the inner surface of the seal socket 115*b* and then installed in the bottom case 110*b*. Subsequently, the top case 120*b* covers the body 111*b* to form the connection device 100*b*. The connection device 100*b* can also be used as a charger connector of a mobile phone body and the like.

In the connector 1*b* and the connection device 100*b* for electronic equipment of the third embodiment, the seal 6*b* is provided adjacent to the end on the connection terminal inserting side of the housing 2*b*, so that the length of the connector 1*b* can be reduced to decrease its occupation area so as to design the layout of the electronic equipment more freely and so as to downsize the electronic equipment. Furthermore, water can be prevented from penetrating between the case and the connector 1*b* and more surely be prevented from further penetrating in the circuit board 8*b*.

Water can completely be prevented from penetrating between the housing 2*b* and the seal 6*b* by welding the housing 2*b* and the seal 6*b*. Furthermore, the housing 2*b* is made of a hard resin while the seal 6*b* is made of a resin softer than the resin of the housing, so that the shape of the housing 2*b* can be maintained to improve the workability of the installation operation and the like and so that water can more surely be prevented from being penetrating between the case and the seal 6*b* by the elasticity of the seal 6*b*. Especially, the waterproof effect between the case and the seal 6*b* becomes extremely improved by providing the double circumferential projections 61*b* on the seal 6*b*.

[Connector and Connection Device for Electronic Equipment of the Fourth Embodiment]

Figure 25:
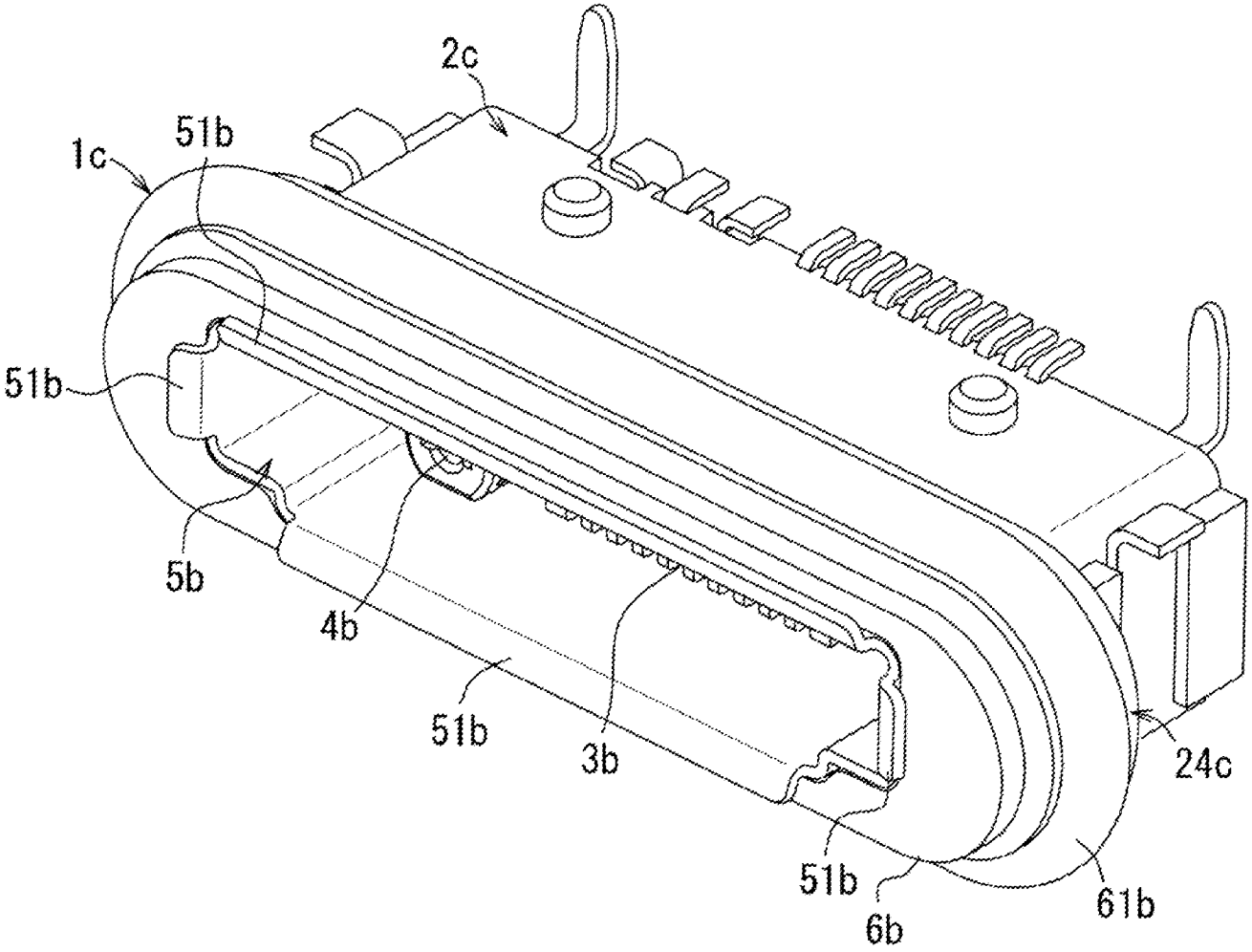
FIG. 25 is a front perspective view of the connector for electronic equipment of the fourth embodiment according to the present invention.
Figure 26:
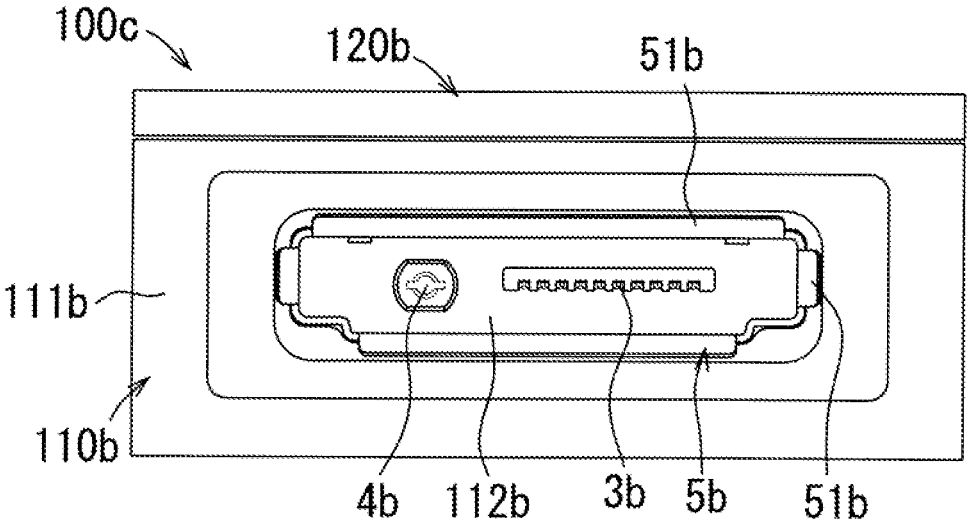
FIG. 26(*a*) is a front view of the connector of the fourth embodiment according to the present invention, in which a circuit board is mounted, and for which the bottom and the top cases are fitted.
Figure 26:
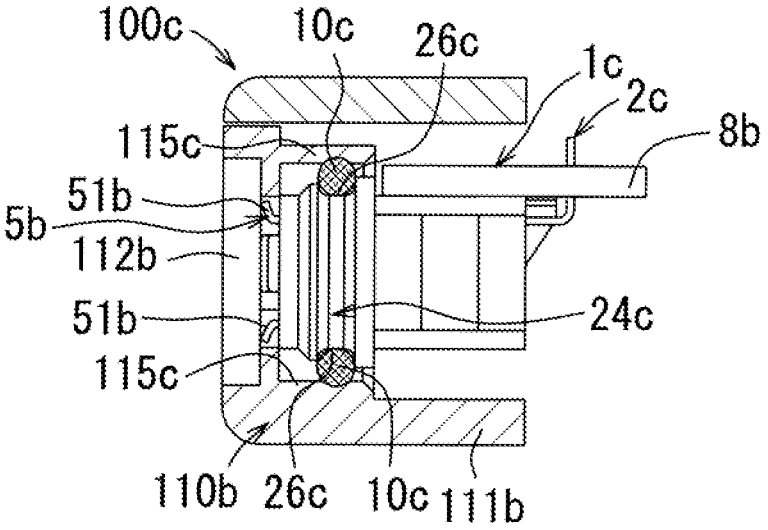

The connector and the connection device for electronic equipment of the fourth embodiment according to the present invention will be explained. The same description as that of the third embodiment will not be explained in particular. FIG. 25 illustrates the connector for electronic equipment of the fourth embodiment. FIG. 26 illustrates the connection device for electronic equipment of the fourth embodiment.

As shown in FIGS. 25 and 26, in the connector 1*c* for electronic equipment of the fourth embodiment, an elongated protrusion 24*c* projects to the periphery and is circumferentially formed adjacent to the end on the connection terminal inserting side of the housing 2*c*, and a groove 26*c* is formed adjacent to the connection terminal inserting side of the elongated protrusion 24*c*. An O-ring 10*c* is engaged with the groove 26*c* and brought into press contact with the inner surface of the seal socket 115*b* of the bottom case 110*b* to form the connection device 100*c*. The remaining parts of the configuration are the same as those of the third embodiment.

In the connector 1*c* and the connection device 100*c* for electronic equipment of the fourth embodiment, the O-ring 10*c* that is a seal is provided adjacent to the end on the connection terminal inserting side of the housing 2*c*, so that the length of the connector 1*c* can be reduced to decrease its occupation area. As a result, to design the layout of the electronic equipment can be realized more freely and downsizing the electronic equipment is possible. This embodiment has a corresponding effect based on the same configuration as that of the third embodiment.

[Variations from these Embodiments]

Besides configurations of each invention, each embodiment, and the like, the invention disclosed herein encompasses variations specified by modifying these partial configurations to other configurations disclosed herein, variations specified by adding other configurations disclosed herein to these configurations, and broader concepts specified by removing these partial configurations to the extent that a partial functional effect is produced. The invention disclosed herein also encompasses the following variations.

For example, the connectors 1, 1*a*, 1*b*, and 1*c* and the connection device 100, 100*a*, 100*b*, and 100*c* of the above-mentioned embodiments can be used for connecting to various kinds of electronic equipment other than a mobile phone. For example, the connectors and the connection device may be used for connecting to such as a personal computer, a portable terminal, a digital camera, and the like. The positions in which the wedges 122 and 92*a*, the projection 241, and the guide 114 are provided respectively are optional within the scope and the spirit of the present invention. Furthermore, the case is optional within the scope and the spirit of the present invention. For example, the case are composed of a right and left cases provided at the right and the left sides of the housing 2 respectively but not the top and the bottom.

INDUSTRIAL APPLICABILITY

The present invention can be used for a connector for various kinds of electronic equipments such as a connector assembly for the charger connector of a mobile phone.

SEQUENCE LISTING

1, 1*a*, 1*b*, 1*c* connector for electronic equipment
2, 2*b* housing
21 support
22, 23 through-hole
24, 24*b*, 24*c* elongated protrusion
241 projection
242 engagement recess
243 joint groove
25 innermost recess
26*c* groove
3, 3*b* contact terminal
4, 4*b* power terminal
5, 5*b* shell
51*b* bending tab
6, 6*b* seal
61*b* circumferential projection
7 another seal
8, 8*b* circuit board
9*a* wedge member
91*a* base body
92*a* wedge
10*c* O-ring
100, 100*a*, 100*b*, 100*c* connection device
110,110*b* bottom case
111,111*b* body
112,112*b* aperture for inserting connection terminal
113 storage recess
114 guide
115*b* seal socket
120,120*a*, 120*b* top case
121 body
122 wedge

The invention claimed is:

1. A mobile terminal connector comprising:

an approximately cylindrical housing having an upper wall, a lower wall and two side walls perpendicular thereto, wherein the upper wall the lower wall and the two side walls each extend in a longitudinal direction of the approximately cylindrical housing from one end of a connection terminal inserting side of the mobile terminal connector to an opposite end of a contact terminal side of the mobile terminal connector;

a support provided in a form of a wall in a rear section of the housing;

a contact terminal and a power terminal supported by the support;

a shell mounted inside the housing; and a seal provided along an outer circumference adjacent to an end on the connection terminal inserting side of the housing, the seal is welded to the housing and made of a resin softer than a resin of the housing, an adhesive is provided in an innermost recess surrounded by an inside of an innermost peripheral wall of the housing and an innermost surface of the support, wherein a position of an end on the upper wall on the connection terminal inserting side of the housing, an end on the lower wall on the connection terminal inserting side of the housing, and an end of both side walls on the connection terminal inserting side of the housing each terminate in a same plane perpendicular to the longitudinal direction of the approximately cylindrical housing, and a position of an opposite end of the upper wall on the contact terminal side of the housing, an opposite end of the lower wall on the contact terminal side of the housing, and an opposite end both side walls on the contact terminal side of the housing each terminate in a same plane perpendicular to the longitudinal direction of the approximately cylindrical housing.

2. The mobile terminal connector according to claim 1 comprising an elongated protrusion peripherally projecting adjacent to the end on the connection terminal inserting side of the housing and then contacting with an innermost end of the seal, wherein an engagement recess is formed on a part of a surface on the connection terminal inserting side of the elongated protrusion and welded to be engaged with the seal, and the seal projects from the end on the connection terminal inserting side of the housing to the connection terminal inserting side and can then be brought into press contact with the surface on the connection terminal inserting side of a case in which the housing is placed.

3. The mobile terminal connector according to claim 1, wherein the seal projects from the end on the connection terminal inserting side of the housing to the connection terminal inserting side and can then be brought into press contact with a surface of the connection terminal inserting side of a case in which the housing is placed.

4. The mobile terminal connector according to claim 3 further comprising an elongated protrusion peripherally projecting adjacent to the end on the connection terminal inserting side of the housing and then contacting with an innermost end of the seal; a projection formed on an innermost surface of the elongated protrusion; and a wedge enabling the housing to be biased to the terminal insertion side by being pushed to the housing side and then contacted with the projection.

5. The mobile terminal connector comprising the mobile terminal connector according to claim 3; and a first case and a second case that form the case, wherein the connector includes an elongated protrusion peripherally projecting adjacent to the end on the connection terminal inserting side of the housing and then contacting with an innermost end of the seal, and a projection formed on an innermost surface of the elongated protrusion, the first case includes a guide guiding the elongated protrusion to a storage recess toward the connection terminal inserting side along an inclined surface, and the second case includes a wedge enabling the housing to be biased to the terminal insertion side by being pushed to a housing side and then contacted with the projection.

* * * * *